US006231160B1

(12) United States Patent
Glass

(10) Patent No.: US 6,231,160 B1
(45) Date of Patent: May 15, 2001

(54) INK JET PRINTER HAVING APPARATUS FOR REDUCING SYSTEMATIC PRINT QUALITY DEFECTS

(75) Inventor: Stephen King Glass, San Diego, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/325,134

(22) Filed: Jun. 2, 1999

(51) Int. Cl.[7] ..... B41J 2/145; B41J 2/15; B41J 2/21

(52) U.S. Cl. ..... 347/40; 347/43

(58) Field of Search ..... 347/40, 43, 9

(56) References Cited

U.S. PATENT DOCUMENTS 4,090,205 * 5/1978 Huffman et al. ..... 347/16
4,812,859 * 3/1989 Chan et al. ..... 347/15
5,691,760 * 11/1997 Hosier et al. ..... 347/238
5,745,131 * 4/1998 Kneezel et al. ..... 347/15
5,883,644 3/1999 Nicoloff, Jr. et al. ..... 347/12
6,099,108 * 8/2000 Weber et al. ..... 347/43

FOREIGN PATENT DOCUMENTS

772150 * 5/1997 (EP) ..... G06K/15/10
0863478A2 9/1998 (EP) .

* cited by examiner

*Primary Examiner*—Thinh Nguyen

(57) ABSTRACT

A printer including apparatus for reducing systematic print quality defects includes, in one embodiment, a printhead with variably spaced nozzles and, in another embodiment, a controller which varies the location along the carriage scan axis that ink is ejected from the nozzles.

21 Claims, 22 Drawing Sheets

INK JET PRINTER HAVING APPARATUS FOR REDUCING SYSTEMATIC PRINT QUALITY DEFECTS

BACKGROUND OF THE INVENTIONS

1. Field of Inventions

The present inventions relate generally to ink jet printers and, more specifically, to apparatus for use with ink jet printers that reduces systematic print quality defects.

2. Description of the Related Art

Ink jet printers can be used to form text images and graphic images on a variety of printing media including, but not limited to, paper, card stock, mylar and transparency stock. The images are formed on print media by printing individual ink spots (or "pixels") in a two-dimensional array of rows and columns. A row is often referred to as a "dot row" or a "pixel row." Multiple pixel rows are formed to create a pixel array that corresponds to the desired image.

Certain ink jet printers include one or more printer cartridges (or "pens") that are carried on a scanning carriage and are capable of printing multiple pixel rows concurrently to create a larger portion of the pixel array. The printer cartridges typically include a printhead with a plurality of ink ejecting nozzles. A 600 dpi (dots-per-inch) printhead with a ½inch swath will, for example, typically have two columns with 150 nozzles in each column. A variety of mechanisms may be used to eject the ink from the nozzles. In one such mechanism, the so-called thermal ink ejection mechanism, ink channels and ink vaporization chambers are disposed between a nozzle orifice plate and a thin film substrate that includes arrays of heater elements such as thin film resistors. The heater elements are selectively energized to heat the ink within selected chambers, thereby causing an ink droplet to be ejected from the nozzles associated with the selected chambers to form ink dots at the desired locations on the print medium.

During a printing operation, the scanning carriage will traverse back and forth over the surface of the print medium. The print medium is advanced in a direction transverse to that of the movement scanning carriage. As the scanning carriage traverses back and forth, a controller causes the nozzles to eject drops of ink at times intended to result in the desired pixel row and, ultimately, the desired pixel array.

One important aspect of printing is image quality which, of course, depends upon the accuracy of the dot placement on the print medium. Variations from perfect dot placement are commonly referred to as dot placement error (DPE). One method of reducing DPE is to simply tighten the tolerances on printer specifications (or DPE specifications) such as drop weight, drop velocity, drop trajectory, medium advancement, printer cartridge/paper spacing, and carriage orientation. This approach is, however, expensive in that meeting relatively tight DPE specification tolerances requires large amounts of design and manufacturing resources to be expended.

At some point, the DPE specification tolerance tightening results in image improvement that is beyond the perception level of a typical viewer. In a relatively high resolution printer (300 dpi or higher), the occasional misdirected ink drop will have essentially no effect on overall image quality. A greater impediment to image quality is visible banding, which occurs when DPEs result in regular repeating patterns. In fact, in many applications, DPE tolerances can be relaxed without a perceptible reduction in image quality if visible banding is eliminated.

One proposed method of reducing banding is disclosed in commonly assigned U.S. application Ser. No. 08/985,641, filed Dec. 5, 1997, and entitled CARRIAGE RANDOM VIBRATION. Here, a vibration inducing element is added to an otherwise conventional ink jet printer to cause minute, random vibrations of the printhead relative to the print medium.

SUMMARY OF THE INVENTIONS

One object of the present inventions is to provide an ink jet printer that avoids, for practical purposes, the aforementioned problems in the art. Another object of the present inventions is to provide a printer that is less susceptible to visible banding than conventional printers.

In order to accomplish some of these and other objectives, a printer in accordance with one embodiment of a present invention includes a printhead having a main body portion and a plurality of nozzles arranged such that spacing, measured along the print media scan axis, between at least a first pair of adjacent nozzles is different than the spacing between at least a second pair of adjacent nozzles. Such a printhead may be used to introduce relatively minor directionality errors throughout each pass, preferably along the media scan axis, thereby eliminating the localized directionality errors that result in visible banding. Such minor, systematic errors are relatively unnoticeable and, in any event, are far less noticeable to the eye than the visible banding. As a result, the present invention reduces visible banding without a noticeable reduction in image quality and does so without the expense associated with the tightening of DPE specifications.

In order to accomplish some of these and other objectives, a printer in accordance with one embodiment of a present invention includes a printer carriage, a printhead carried by the carriage, and a controller operably connected to the printer carriage and printhead. The controller is adapted to receive image information from a host device corresponding to respective predetermined dot printing locations along the carriage scan axis and to control at least one of the printer carriage and printhead such that at least some dots are intentionally printed at respective adjusted dot printing locations on the carriage scan axis that are offset from their respective predetermined dot locations.

A printer in accordance with the present invention will print respective ink dots (i.e. eject ink) at dot printing locations on the carriage scan axis that are varied, by amounts that may change from scan to scan, from the respective dot printing locations that correspond to the image information received from a host device. This, in turn, varies where the dots will actually land on the print medium. As a result, visible banding which results from regular repeating patterns of errors will be reduced or eliminated. Here too, this is accomplished without the expense associated with the tightening of DPE specifications.

The above described and many other features and attendant advantages of the present inventions will become apparent as the inventions become better understood by reference to the following detailed description when considered in conjunction with the accompanying drawings.

BRIEF DESCRIPTION OF THE DRAWINGS

Detailed description of preferred embodiments of the inventions will be made with reference to the accompanying drawings.

DETAILED DESCRIPTION OF THE PREFERRED EMBODIMENTS

The following is a detailed description of the best presently known mode of carrying out the inventions. This description is not to be taken in a limiting sense, but is made merely for the purpose of illustrating the general principles of the inventions. Additionally, it is noted that detailed discussions of various internal operating components of ink jet printers which are not pertinent to the present inventions, such as specific details of the image processing system and interaction with a host computer, have been omitted for the sake of simplicity.

Figure 1:
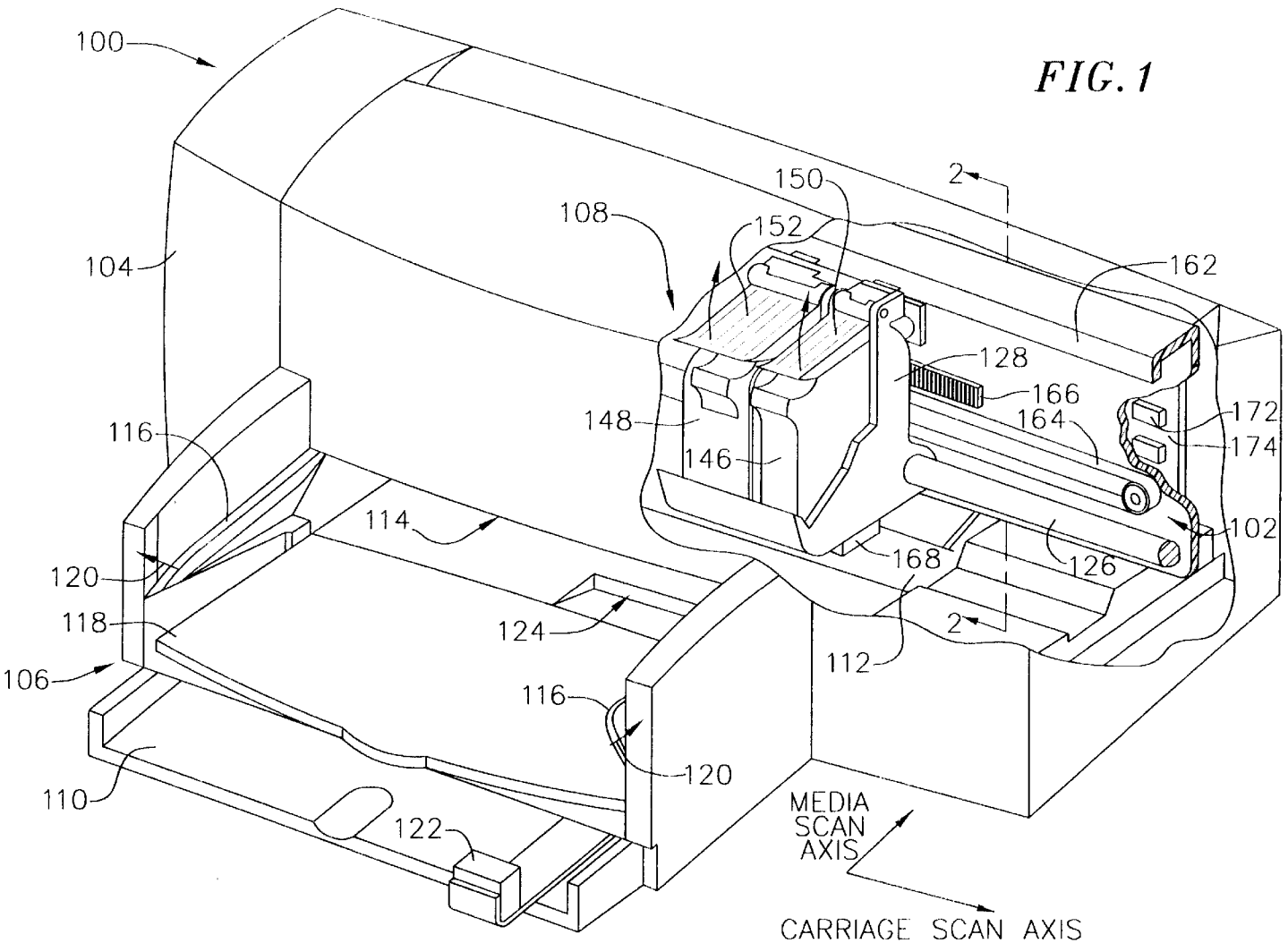
FIG. 1 is a partially cutaway perspective view of a printer in accordance with a preferred embodiment of a present invention.

As illustrated for example in FIG. 1, a printer 100 in accordance with a preferred embodiment of the present invention includes a chassis 102 that is surrounded by a housing 104, a print media handling system 106, and a printing system 108. One example of a printer that includes the same basic components, albeit without the inventive modifications discussed in greater detail below, is the Hewlett-Packard DeskJet 722 ink jet printer.

The exemplary print media handling system 106 includes a feed tray 110 for storing print media, and a series of conventional motor-driven rollers, including a drive roller 112 that is driven by a stepper motor, for advancing print media along the media scan axis from the feed tray into a printing zone 114, and from the printing zone onto a pair of output drying wing members 116. The output drying wing members 116, which are shown in their respective extended positions, hold media on which an image has been printed above any previously printed media output that may be resting in an output tray 118. After a period that is suitable to allow the previously printed media to dry has passed, the output drying wing members 116 will retract in the respective directions indicated by arrows 120 so as to allow the newly printed media thereon to fall into the output tray 118.

A wide variety of sizes and types of print media can be accommodated by the exemplary print media handling system 106. To that end, the exemplary print media handling system 106 includes an adjustment arm 122 and an envelope feed slot 124.

Figure 2:
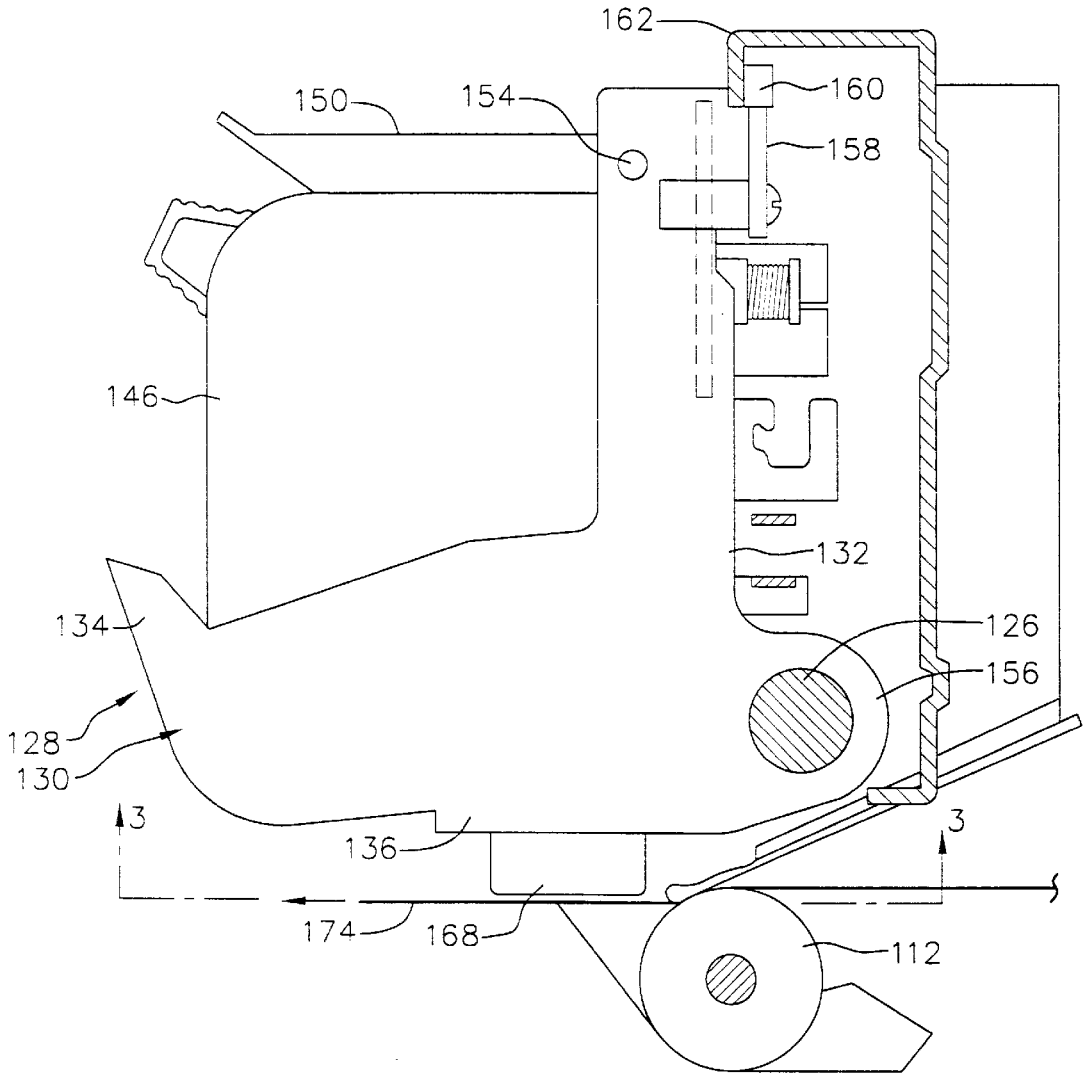
FIG. 2 is a side view of the printer carriage and printhead cartridge illustrated in FIG. 1.
Figure 3:
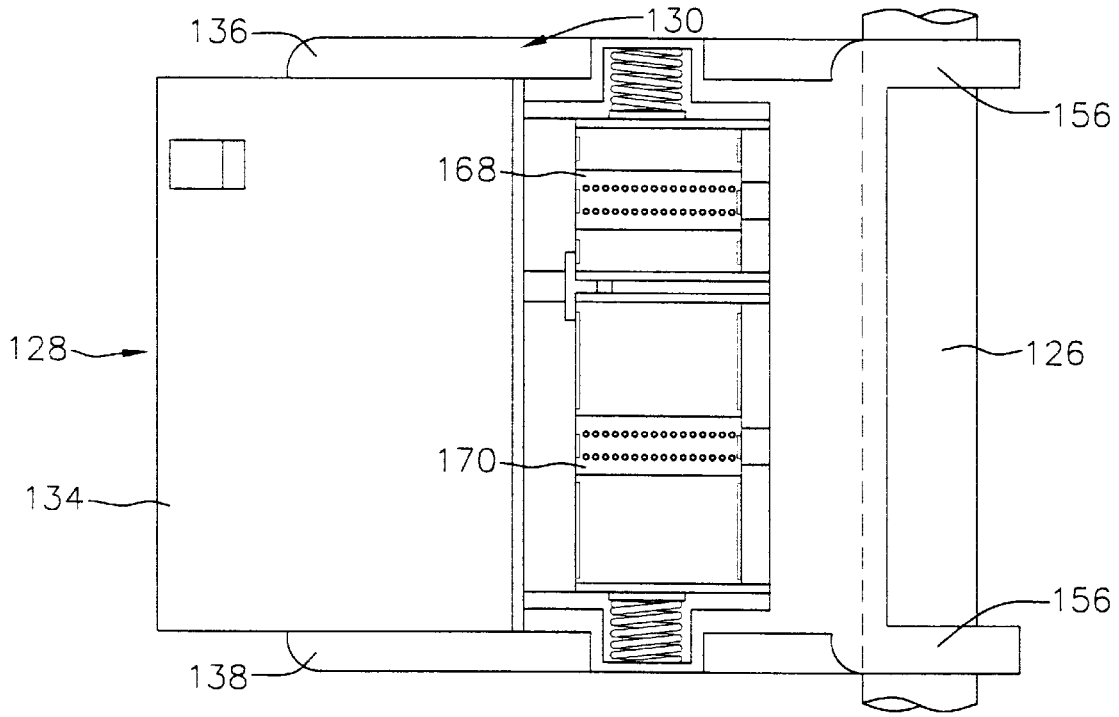
FIG. 3 is a bottom view of the printer carriage and printhead cartridge illustrated in FIG. 2.
Figure 4:
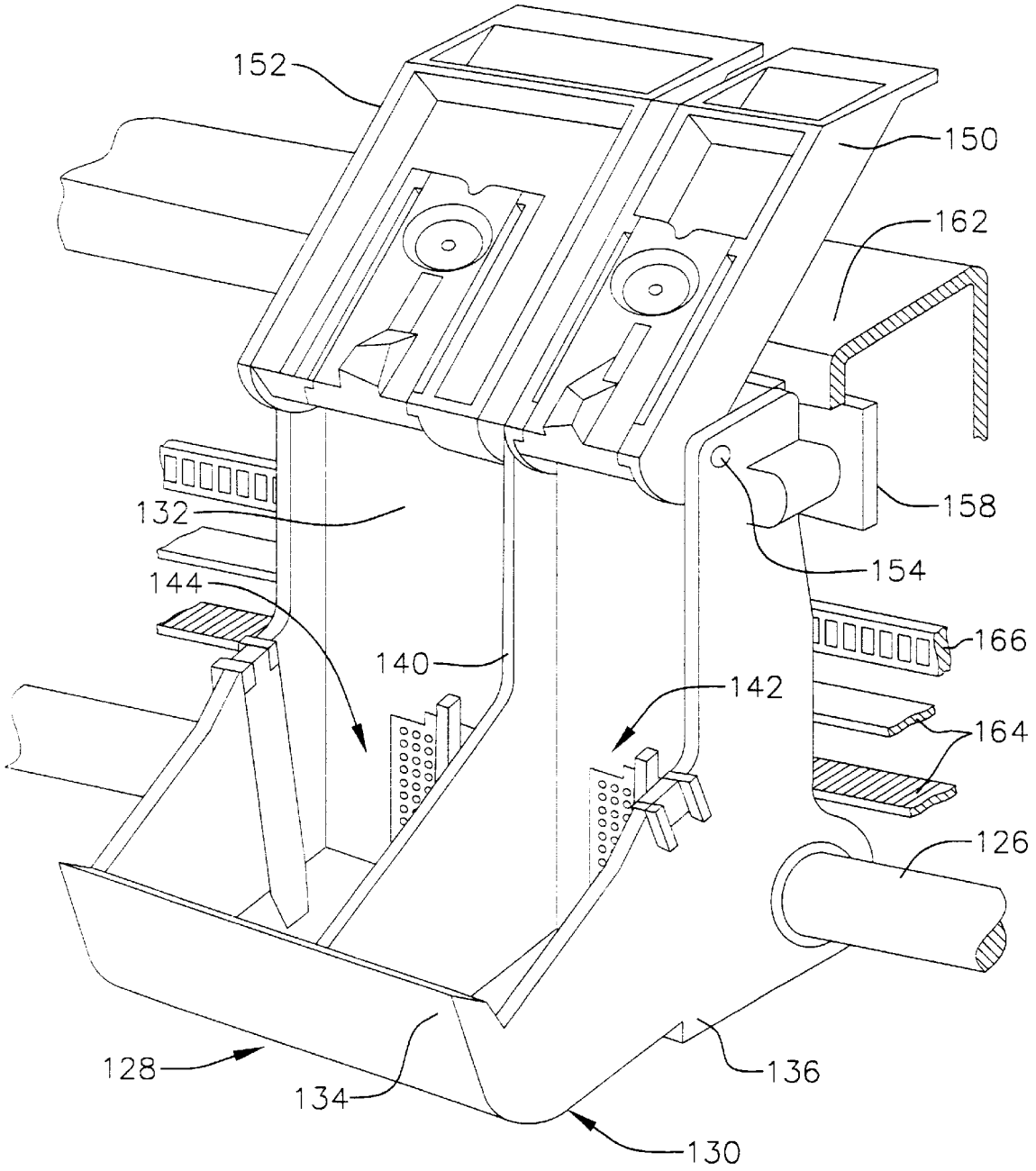
FIG. 4 is a perspective view of the printer carriage illustrated in FIG. 2 with the printhead cartridge removed.

As illustrated for example in FIGS. 1–4, the exemplary printing system 108 includes a printer carriage slider rod 126 that is supported by the chassis 102 and a printer carriage 128 that reciprocatingly slides (or scans) back and forth along the slider rod, thereby defining the carriage scan axis. Referring more specifically to FIGS. 2–4, the exemplary printer carriage 128 consists primarily of a main body 130 having a rear wall 132, a front apron 134, L-shaped side walls 136 and 138, and an alignment web 140 that divides the interior of the main body into first and second chambers 142 and 144. The first and second chambers 142 and 144 respectively house first and second removable ink jet printhead cartridges 146 and 148 (also referred to as "pen cartridges, " "print cartridges" and "cartridges"). A pair of latch members 150 and 152, which are pivotably attached to a hinge 154, hold the printhead cartridges 146 and 148 in place.

The exemplary printer carriage 128 illustrated in FIGS. 1–4 also includes a pair of bearings 156 which slidably support the carriage on the slider rod 126. A vertical anti-rotation guide arm 158 having a slide bushing 160 is attached to the main body rear wall 132. The slide bushing 160 engages a horizontally extending anti-rotation guide bar 162. The bearings 156 and slide bushing 160 provide a three-point printer carriage support system, while the vertical anti-rotation guide arm 158, slide bushing, and horizontally extending anti-rotation guide bar 162 prevent the printer carriage 128 from pivoting forwardly about the slider rod 126.

As noted above, the printer carriage 128 reciprocatingly scans back and forth on the slider rod 126. Referring to FIGS. 1 and 4, an endless belt 164, which is driven in a conventional manner, is used to drive the printer carriage 128. A linear encoder strip 166 is sensed to determine the position of the printer carriage 128 on the scan axis using conventional techniques. The encoder strip 166 is, in conventional printers, indexed at time 0 to determine the nozzle firing times (i.e. the times at which the nozzles eject ink during each pass). Such indexing may be varied in accordance an invention herein, as is discussed in greater detail below.

Turning to the printhead cartridges, the exemplary printhead cartridges 146 and 148 illustrated in FIGS. 2 and 3 include printheads 168 and 170 that each have a plurality of downwardly facing ink ejecting nozzles. One example of a suitable ink jet printer carriage, which may be modified in the manner discussed below with reference to FIGS. 5–22, is disclosed in commonly assigned U.S. patent application Ser. No. 08/757,009, filed Nov. 26, 1996, which is incorporated herein by reference. Additionally, although the illustrated embodiment includes two printhead cartridges (a monotone cartridge 146 and a tri-color cartridge 148), other combinations, such as four discrete monochrome cartridges or a single monotone cartridge, may also be employed.

The exemplary printer 100 illustrated in FIG. 1 also includes a controller 172 on a printed circuit board 174. The controller 172 receives instructions from a host device such as a personal computer and, in response to these instructions, controls the operations of the various components in the print media handling system 106 and the printing system 108. More specifically, the controller 172 controls the advancement of a sheet of print media 174 through the printing zone 114 by way of the print media handling system 106, the reciprocating movement of the printer carriage 128, and the firing of the various printhead cartridge nozzles based on the location of the print medium, the location of the printer carriage and the instructions from the host device.

In accordance with one invention herein, one or all of the printhead cartridges include a nozzle spacing arrangement wherein the nozzles are not all equally spaced. As illustrated for example in FIG. 5, one embodiment of a present invention may include a printhead nozzle plate 176 having a plurality of nozzles 178. The exemplary nozzle plate 176, which is only partially illustrated in FIG. 5 and is not drawn to scale, includes 524 nozzles at 600 dpi, with the odd numbered nozzles in a first column and the even numbered nozzles in a second column. Thus, nozzle number 1 is the first nozzle (or nozzle closest to the ink source) in the odd numbered column, nozzle number 2 is the first nozzle in the even numbered column, and so on. The columns are offset from one another by approximately one dot row in the media scan axis direction such that successive dot rows are made up of dots produced by nozzles in opposite columns. If the nozzles in each column were equally spaced in the conventional manner, the nozzles would be located at the nominal nozzle locations 180 shown in dashed lines, which is where the controller 172 in the present invention assumes that they are. In accordance with a present invention, however, many of the nozzles are in fact located at respective actual nozzle locations, shown in solid lines, that are offset from their respective nominal nozzle locations by an adjustment amount $\Delta L$.

The benefits of such offsetting can be explained as follows. A printhead with perfect nozzle directionality will, of course, produce the best image, while a printhead with only a few regions of directionality errors will produce visible banding over multiple passes. The present invention, on the other hand, may be used to introduce relatively minor directionality errors throughout the printhead, preferably along the media scan axis. Such minor, systematic errors are far less noticeable to the eye than the visible banding that results from having only localized directionality errors.

Figure 5:
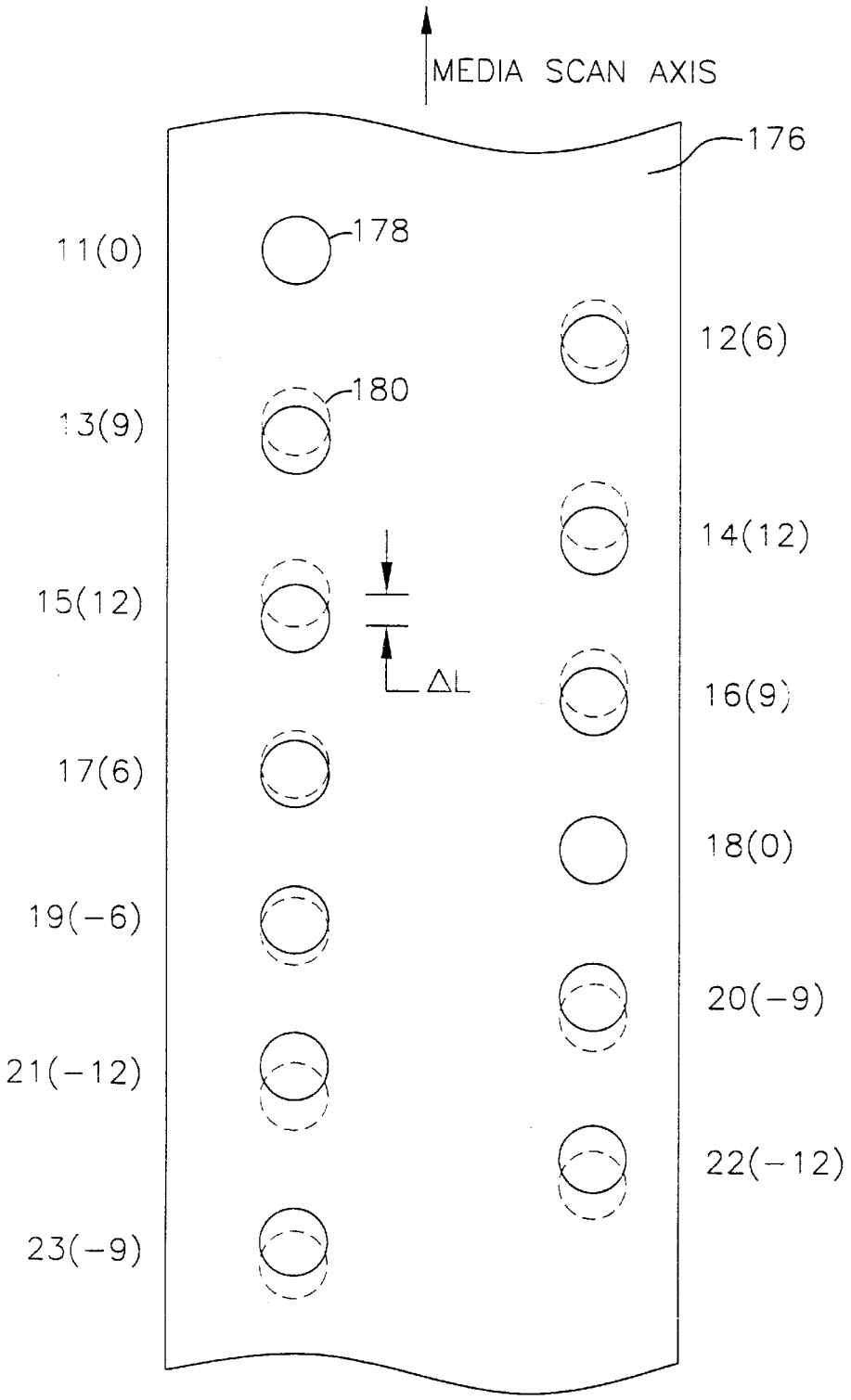
FIG. 5 is a partial plan view of a printhead orifice plate in accordance with a preferred embodiment of a present invention.
Figure 6:
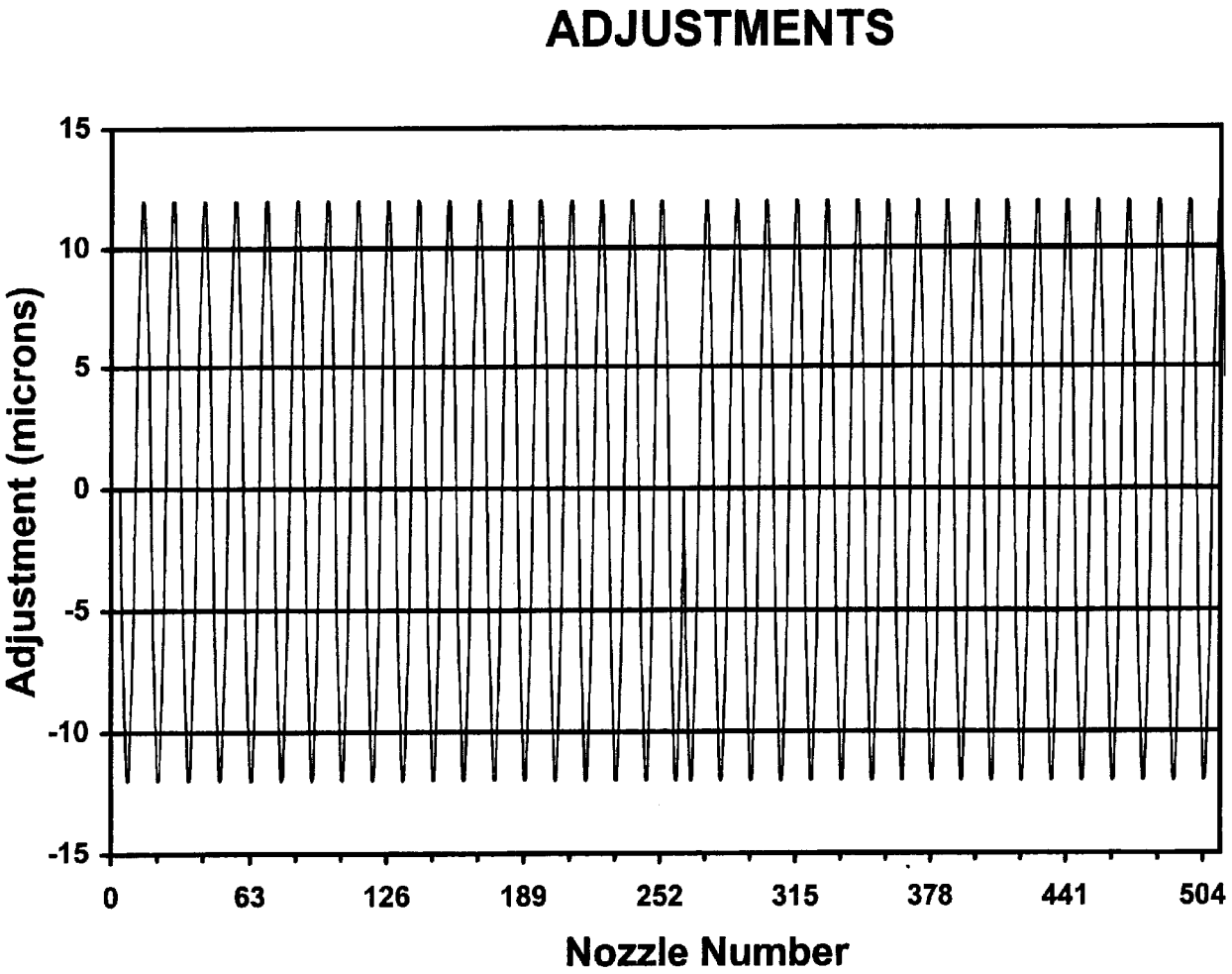
FIG. 6 is a graph showing the nozzle location adjustments of an exemplary multiple nozzle printhead in accordance with a preferred embodiment of a present invention.

In one implementation, and as shown by way of example in FIG. 6, the adjustment amount $\Delta L$ may vary from dot row to dot row in such a manner that a regular, repeating, essentially sinusoidal pattern of adjustment amounts is formed. In the illustrated example, the adjustment amount $\Delta L$ varies from positive one-fourth of a dot row (about 12 microns in the 600 dpi embodiment) to negative one-forth of a dot row. Positive and negative are indicative of direction along the media scan axis. This aspect of the invention is also illustrated in FIG. 5, where nozzles 11–23 are identified by nozzle number with their respective adjustment amounts $\Delta L$ in parenthesis. Note, for example, that nozzle number 13 is offset by 9 microns in one direction and nozzle number 21 is offset by 12 microns in the negative, or opposite, direction.

The exemplary nozzle arrangement illustrated in FIGS. 5 and 6 may be employed in printers that operate in a variety of print modes such as, for example, the eight-pass, six-pass and four-pass modes. The exemplary printhead includes 524 nozzles, of which 504 (here, nozzles 11–514) will be used in any of the eight-pass, six-pass and four-pass modes. Thus, the eight-pass mode will employ a 63 nozzle advance after each pass, the six-pass mode will employ a 84 nozzle advance and the fourpass mode will employ a 128 nozzle advance. A 504 nozzle selection is particularly useful because this number is a whole number multiple of 21, i.e. (8) (63) (21)=(6) (84) (21)=(4) (128) (21)=504. Thus, the same printhead with a 21 nozzle adjustment period can be used for all three print modes.

Figure 7:
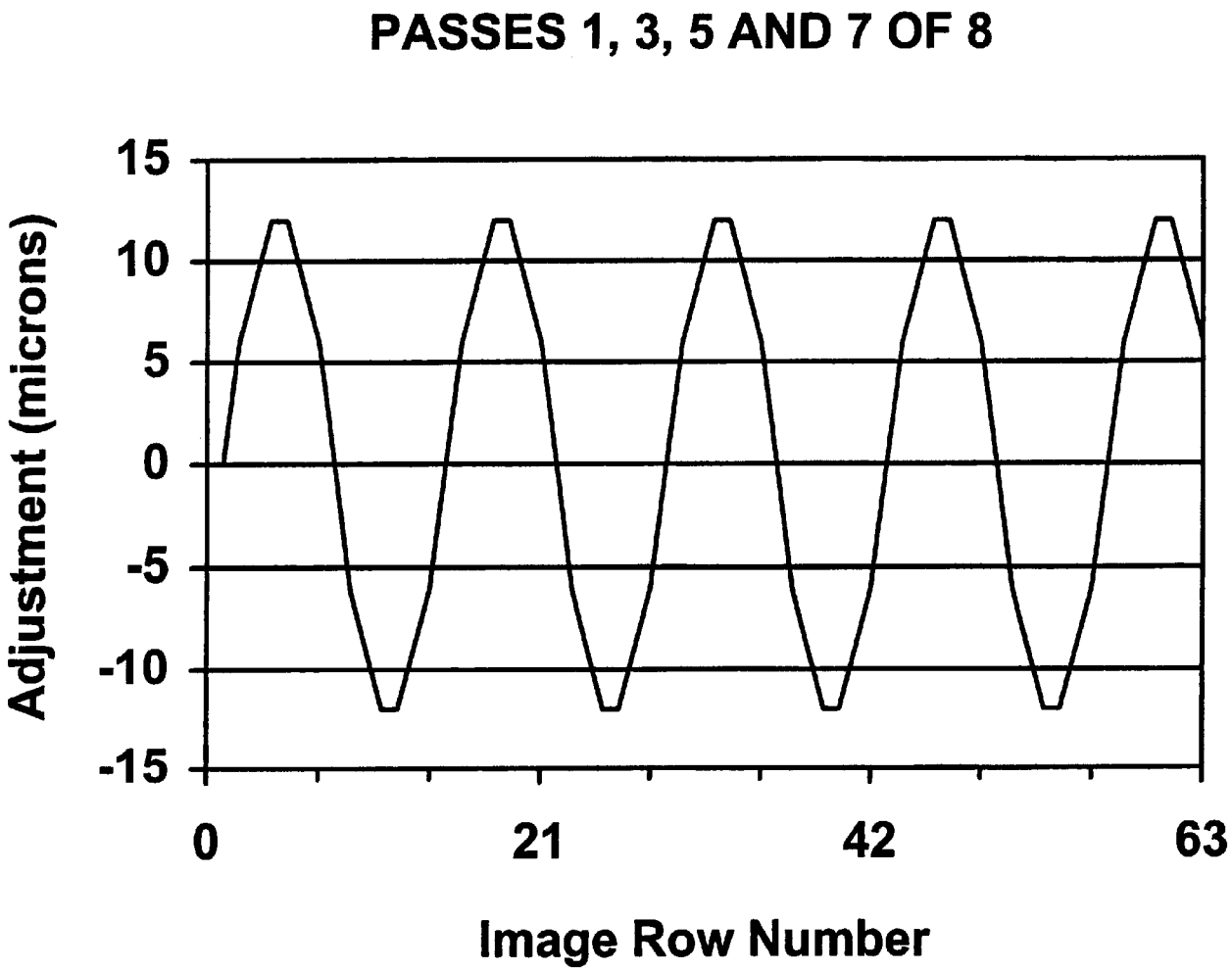
FIG. 7 is a graph showing the nozzle location adjustments in passes one, three, five and seven in an eight-pass printing mode employing a printhead with the exemplary nozzle location adjustments illustrated in FIG. 6.
Figure 8:
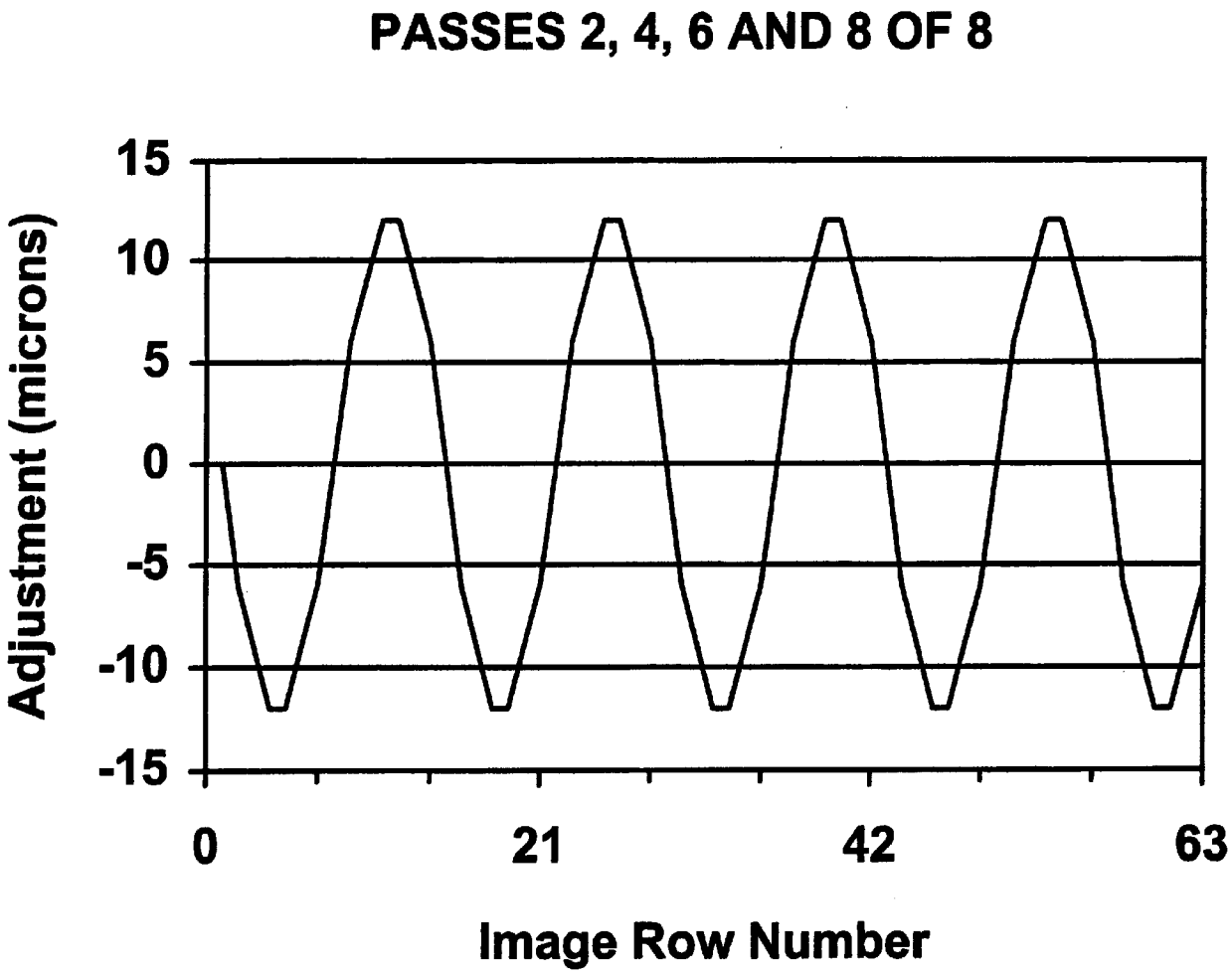
FIG. 8 is a graph showing the nozzle location adjustments in passes two, four, six and eight in an eight-pass printing mode employing a printhead with the exemplary nozzle location adjustments illustrated in FIG. 6.
Figure 9:
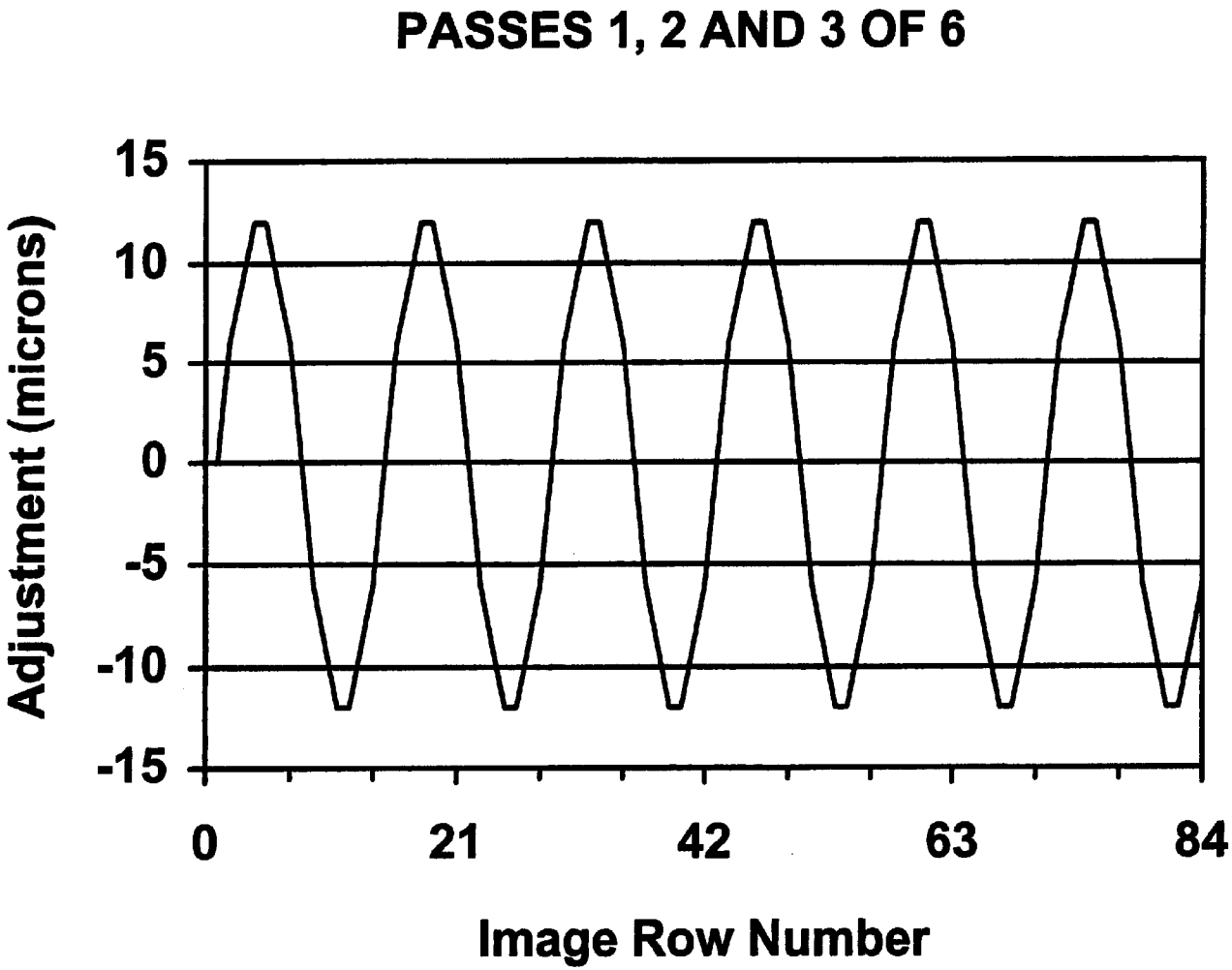
FIG. 9 is a graph showing the nozzle location adjustments in passes one, two and three in a six-pass printing mode employing a printhead with the exemplary nozzle location adjustments illustrated in FIG. 6.
Figure 10:
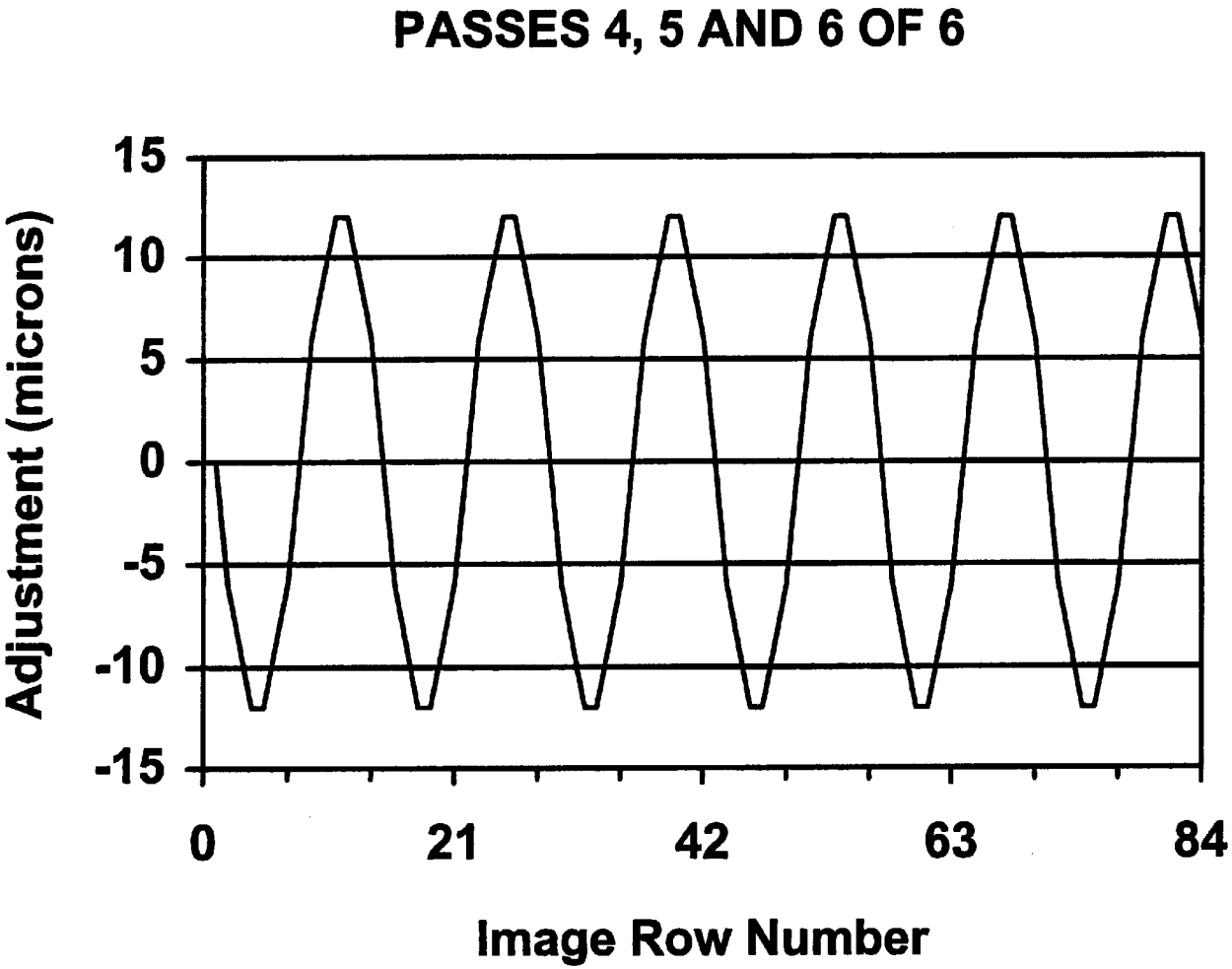
FIG. 10 is a graph showing the nozzle location adjustments in passes four, five and six in a six-pass printing mode employing a printhead with the exemplary nozzle location adjustments illustrated in FIG. 6.
Figure 11:
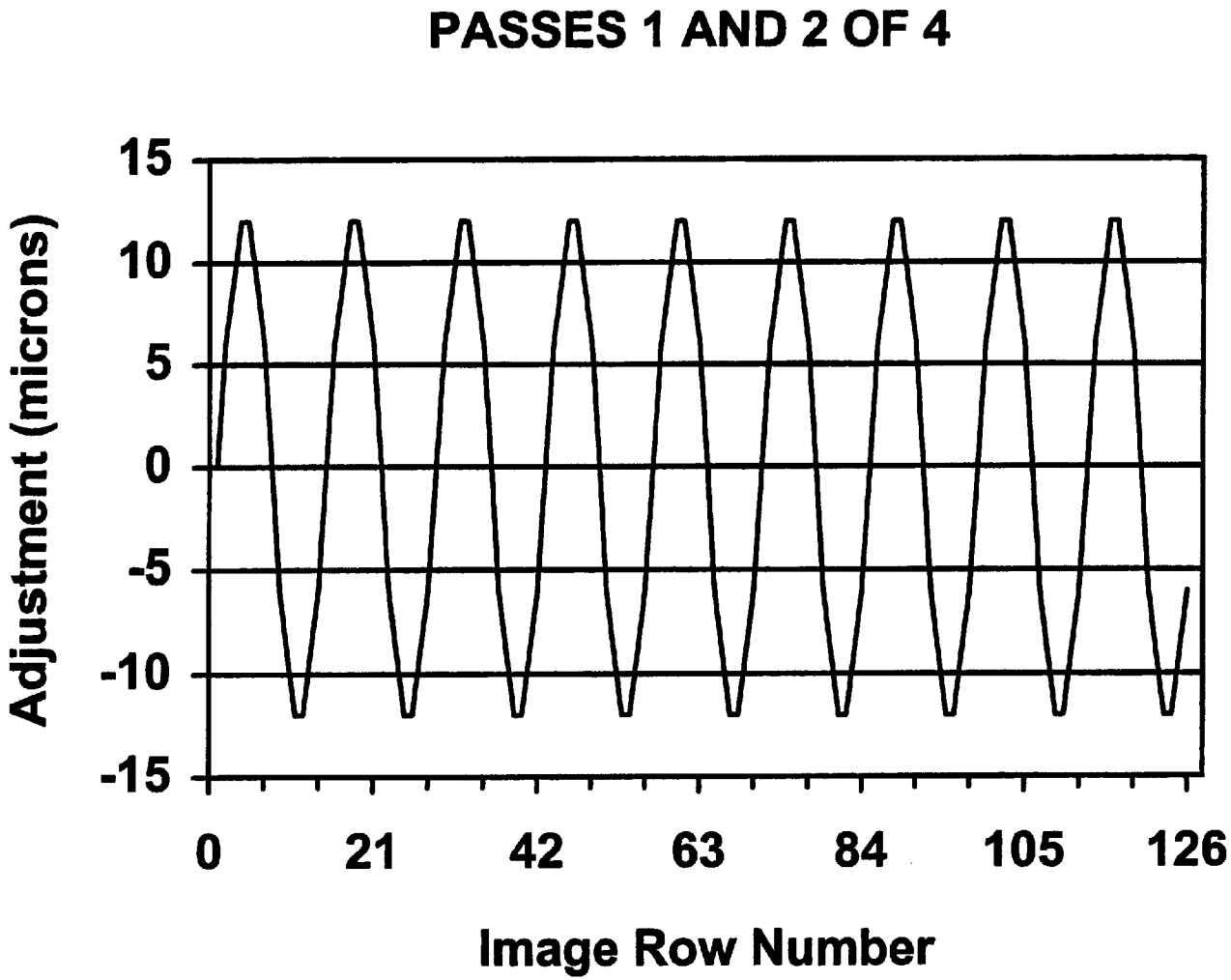
FIG. 11 is a graph showing the nozzle location adjustments in passes one and two in a four-pass printing mode employing a printhead with the exemplary nozzle location adjustments illustrated in FIG. 6.
Figure 12:
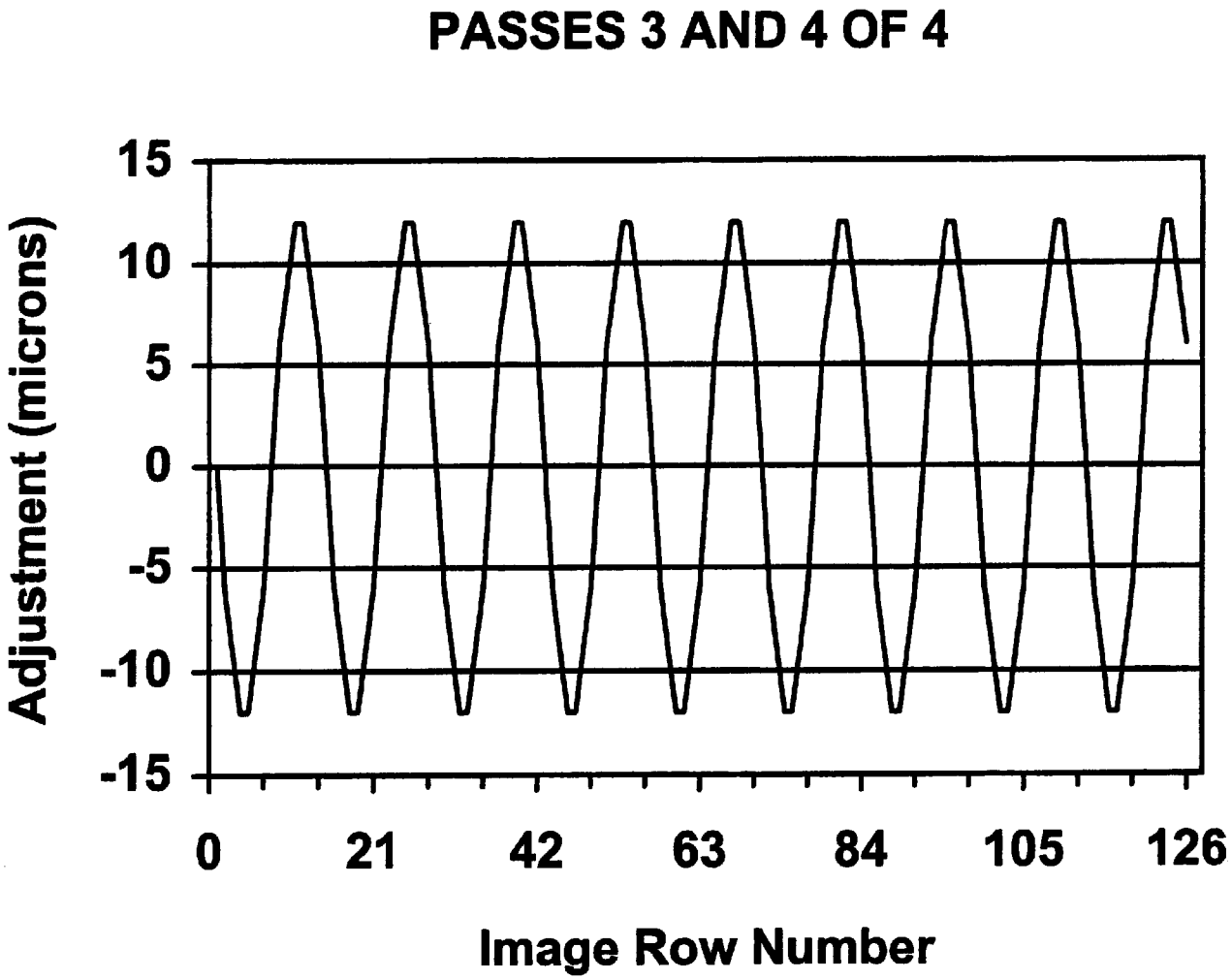
FIG. 12 is a graph showing the nozzle location adjustments in passes three and four in a four-pass printing mode employing a printhead with the exemplary nozzle location adjustments illustrated in FIG. 6.
Figure 13:
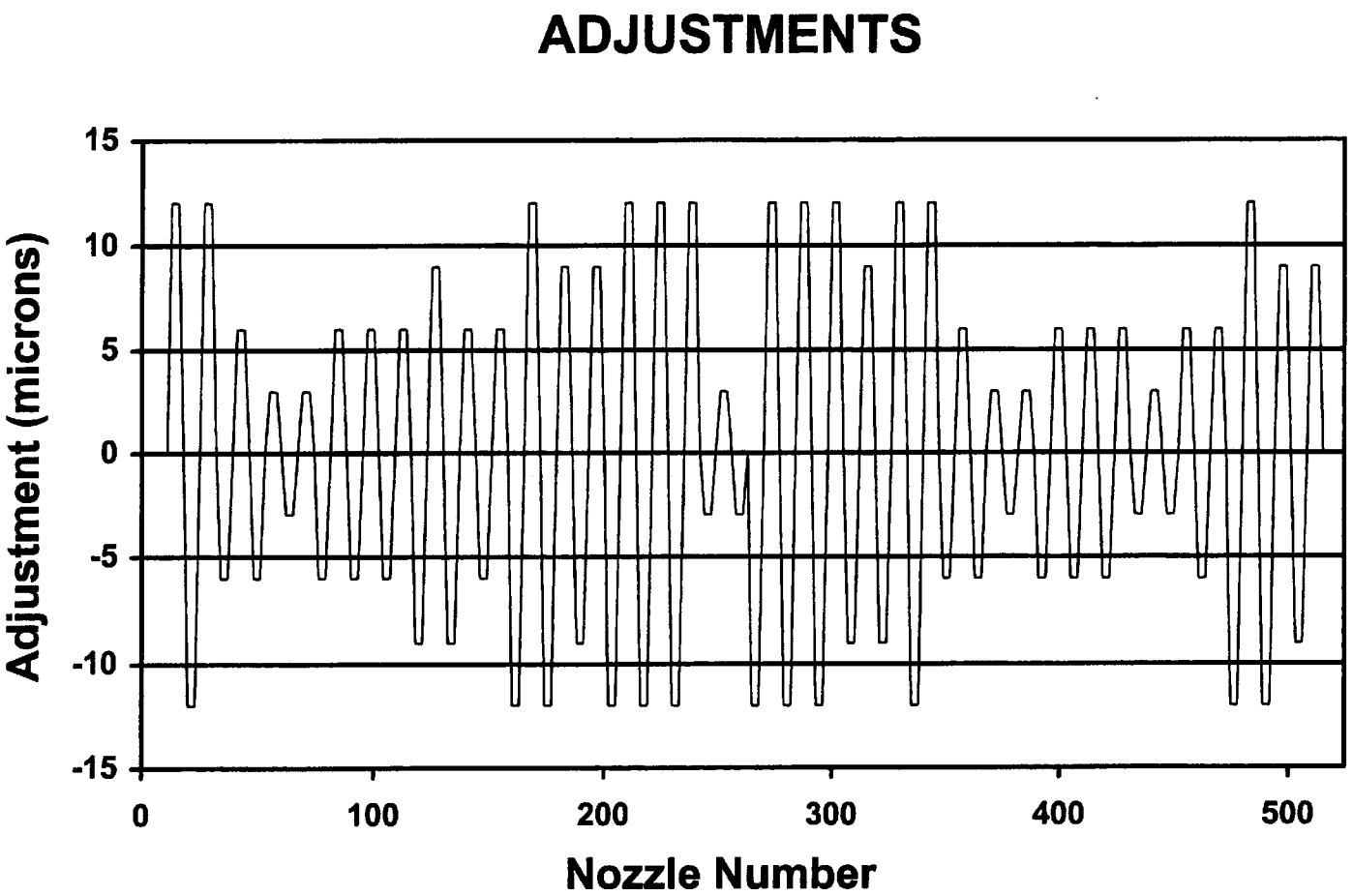
FIG. 13 is a graph showing the nozzle location adjustments of an exemplary multiple nozzle printhead in accordance with another preferred embodiment of a present invention.

Turning to FIGS. 7 and 8, the adjustment amounts $\Delta L$ as a function of image row number for the various passes in an eight-pass mode are shown. Note that in the first pass image row number 1 corresponds to nozzle 11 and image row number 2 corresponds to nozzle 12, while in the second pass image row number 1 corresponds to nozzle 74 and image row number 2 corresponds to nozzle 75. The adjustment amounts $\Delta L$ as a function of image row number for the various passes in the six-pass mode are shown in FIGS. 9 and 10, while the adjustment amounts for the four-pass mode are shown in FIGS. 11 and 12. In each case, the period of the essentially sinusoidal variation of the adjustment amount $\Delta L$ is 21 image rows (or 21 consecutively numbered nozzles).

Although the variation of the adjustment amounts $\Delta L$ in the embodiment illustrated in FIGS. 5–12 results in essentially uniform adjustment amounts from pass to pass, and essentially introduces systematic uniform dot placement error into the printing process, such uniformity is not required. In the exemplary embodiment illustrated in FIG. 13, the adjustment amounts ΔL range from positive one-fourth of a dot row (about 12 microns in the 600 dpi embodiment) to negative one-forth of a dot row as they did in the prior embodiment. However, the magnitude of the adjustment amounts is not uniform from pass to pass or from period to period.

Figure 14:
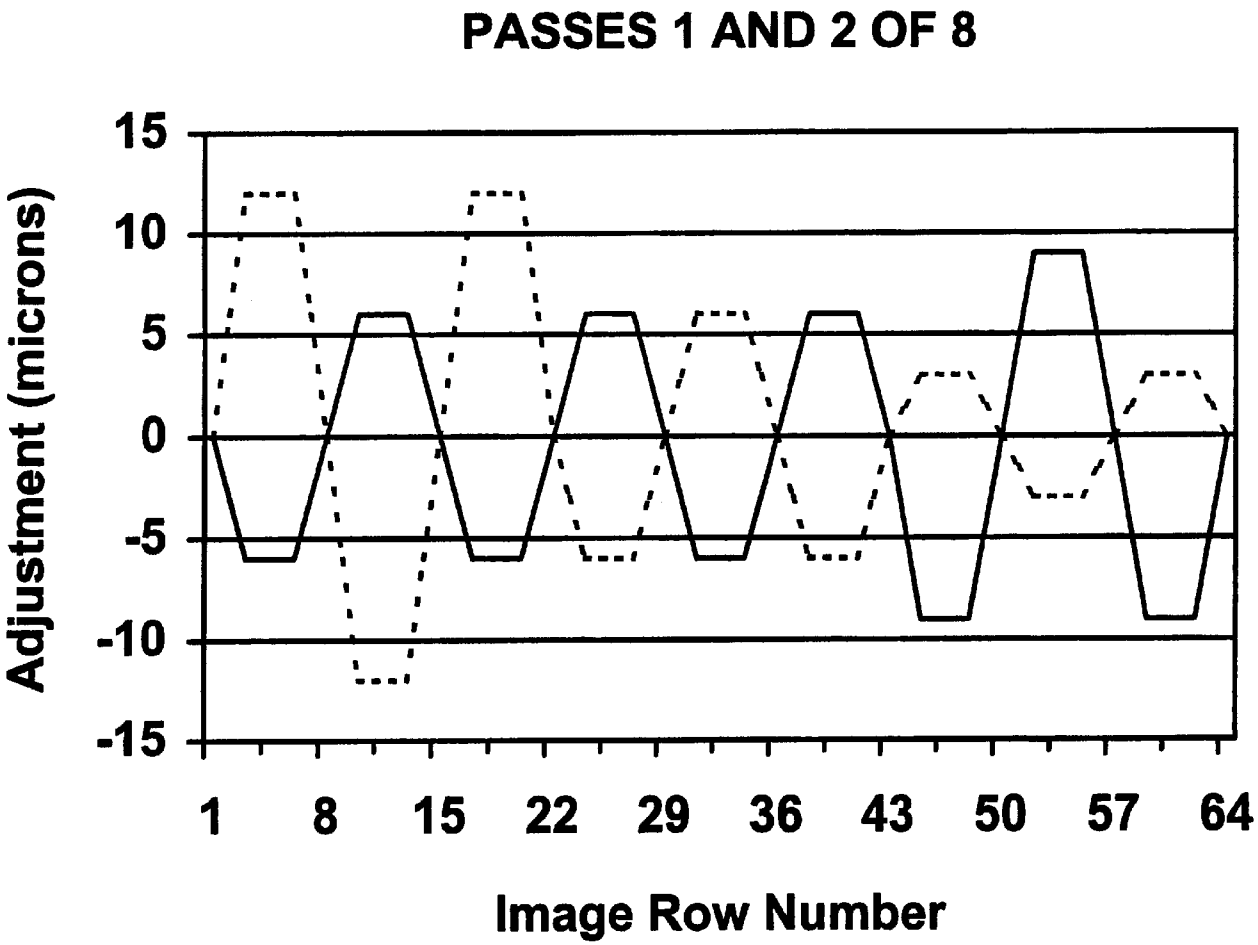
FIG. 14 is a graph showing the nozzle location adjustments in passes one and two in an eight-pass printing mode employing a printhead with the exemplary nozzle location adjustments illustrated in FIG. 13.
Figure 15:
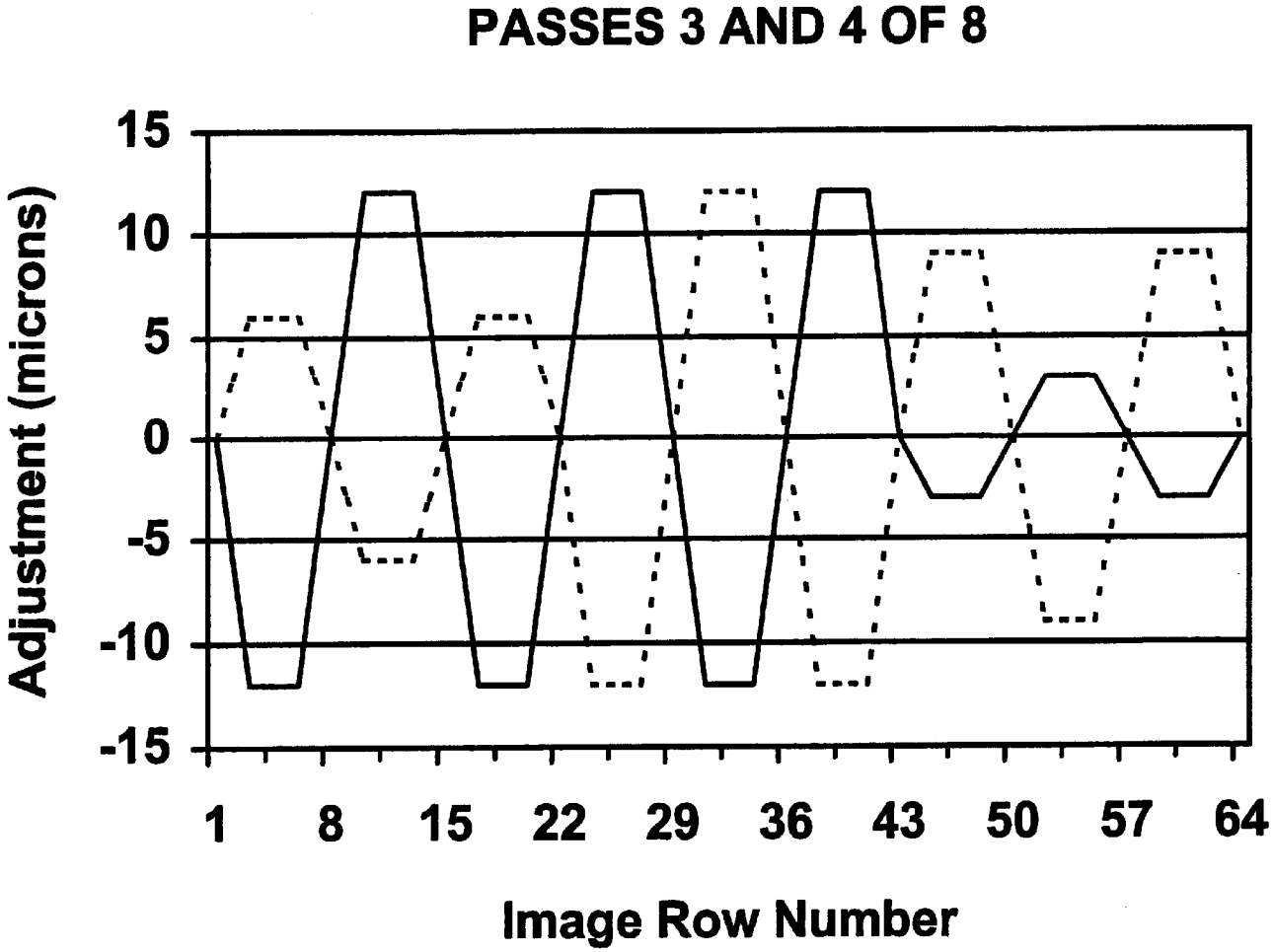
FIG. 15 is a graph showing the nozzle location adjustments in passes three and four in an eight-pass printing mode employing a printhead with the exemplary nozzle location adjustments illustrated in FIG. 13.
Figure 16:
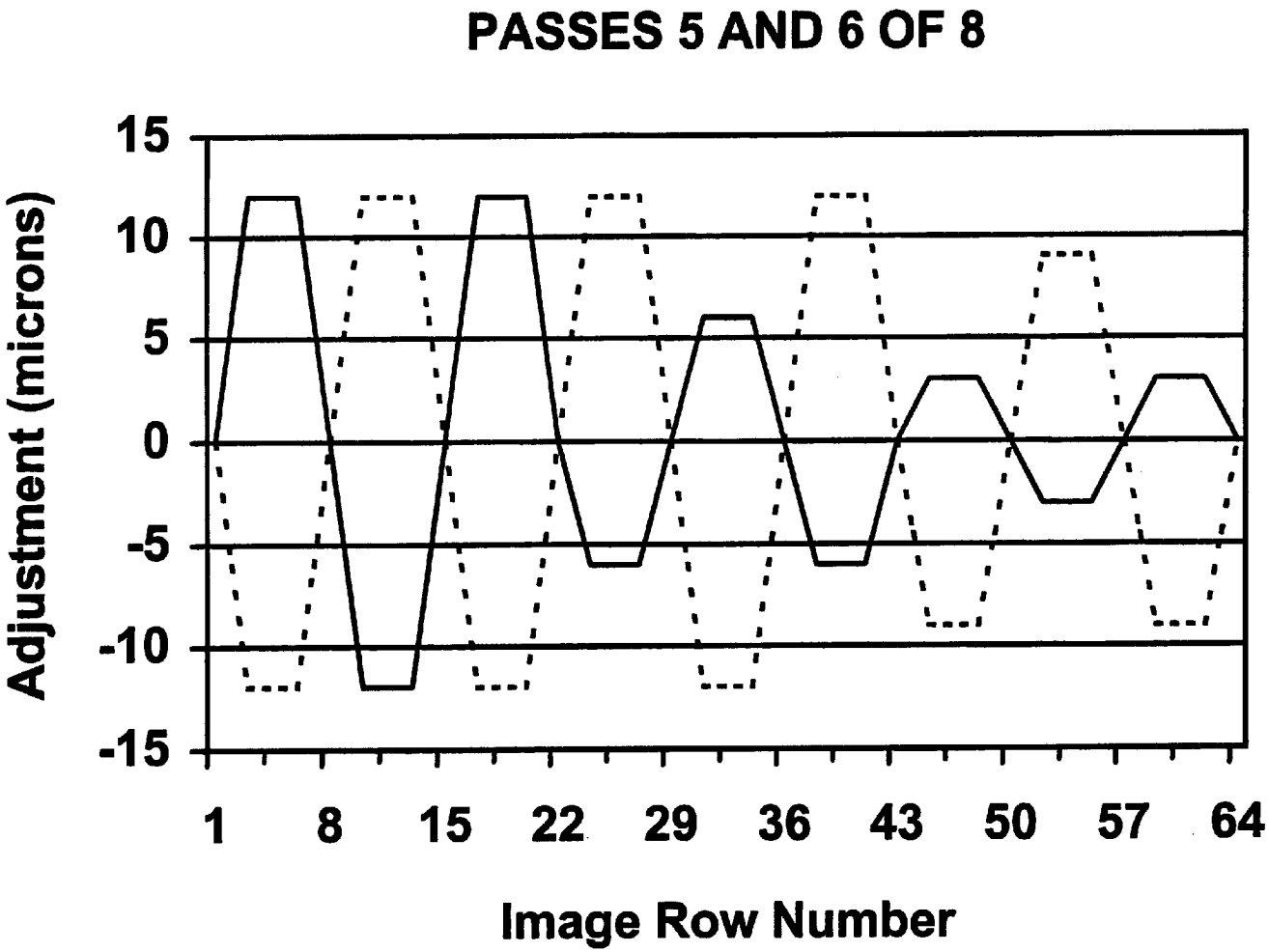
FIG. 16 is a graph showing the nozzle location adjustments in passes five and six in an eight-pass printing mode employing a printhead with the exemplary nozzle location adjustments illustrated in FIG. 13.
Figure 17:
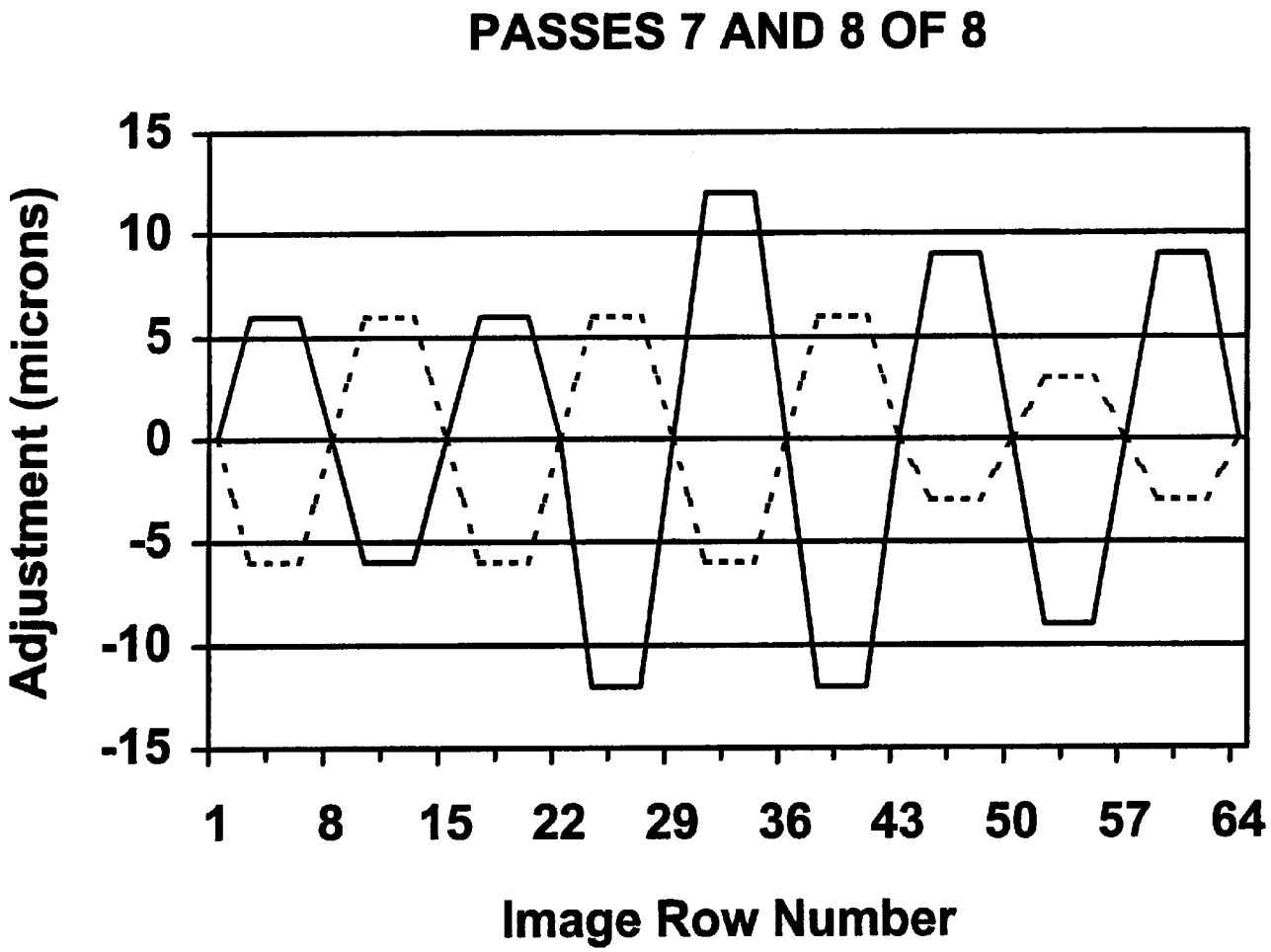
FIG. 17 is a graph showing the nozzle location adjustments in passes seven and eight in an eight-pass printing mode employing a printhead with the exemplary nozzle location adjustments illustrated in FIG. 13.
Figure 18:
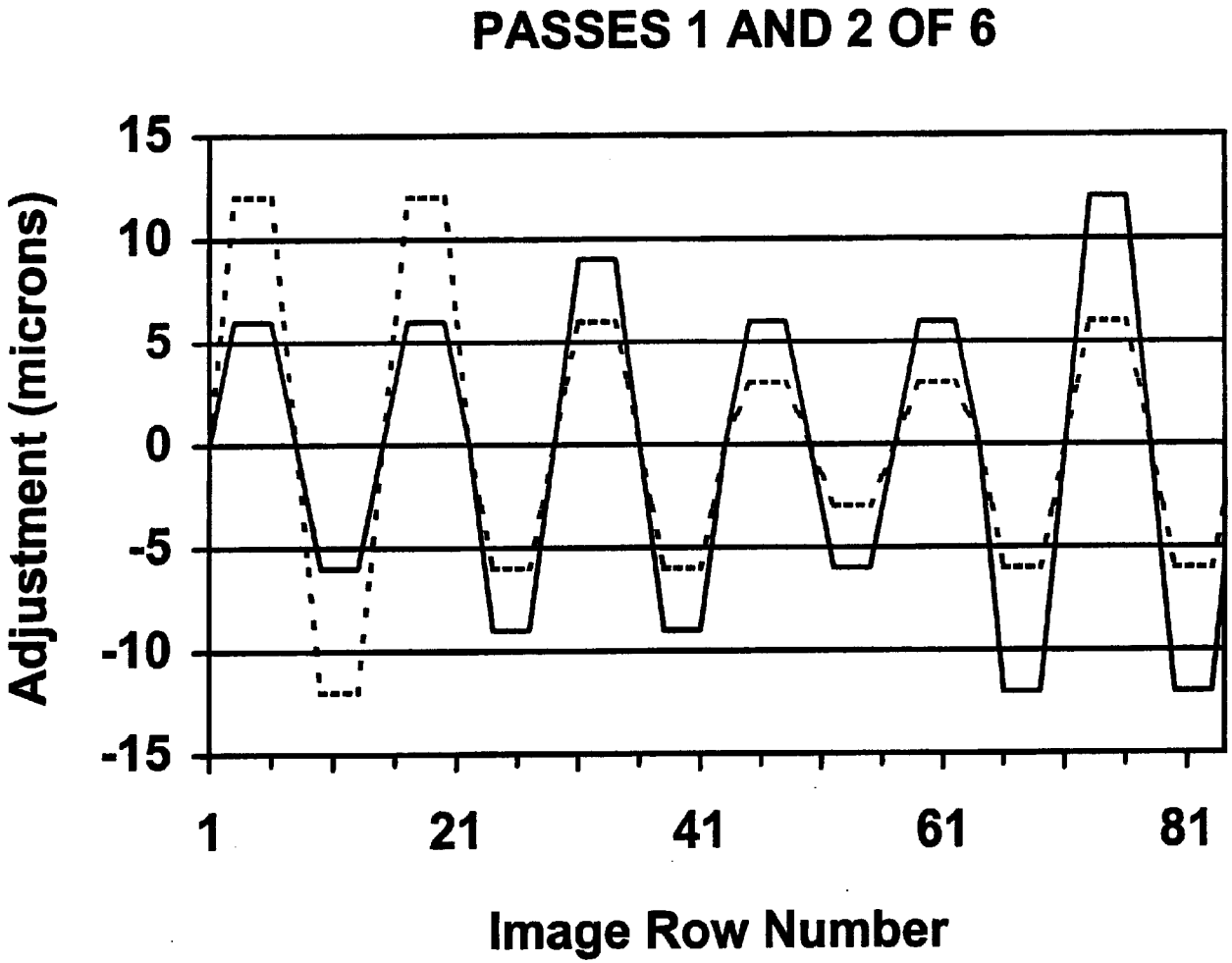
FIG. 18 is a graph showing the nozzle location adjustments in passes one and two in a six-pass printing mode employing a printhead with the exemplary nozzle location adjustments illustrated in FIG. 13.
Figure 19:
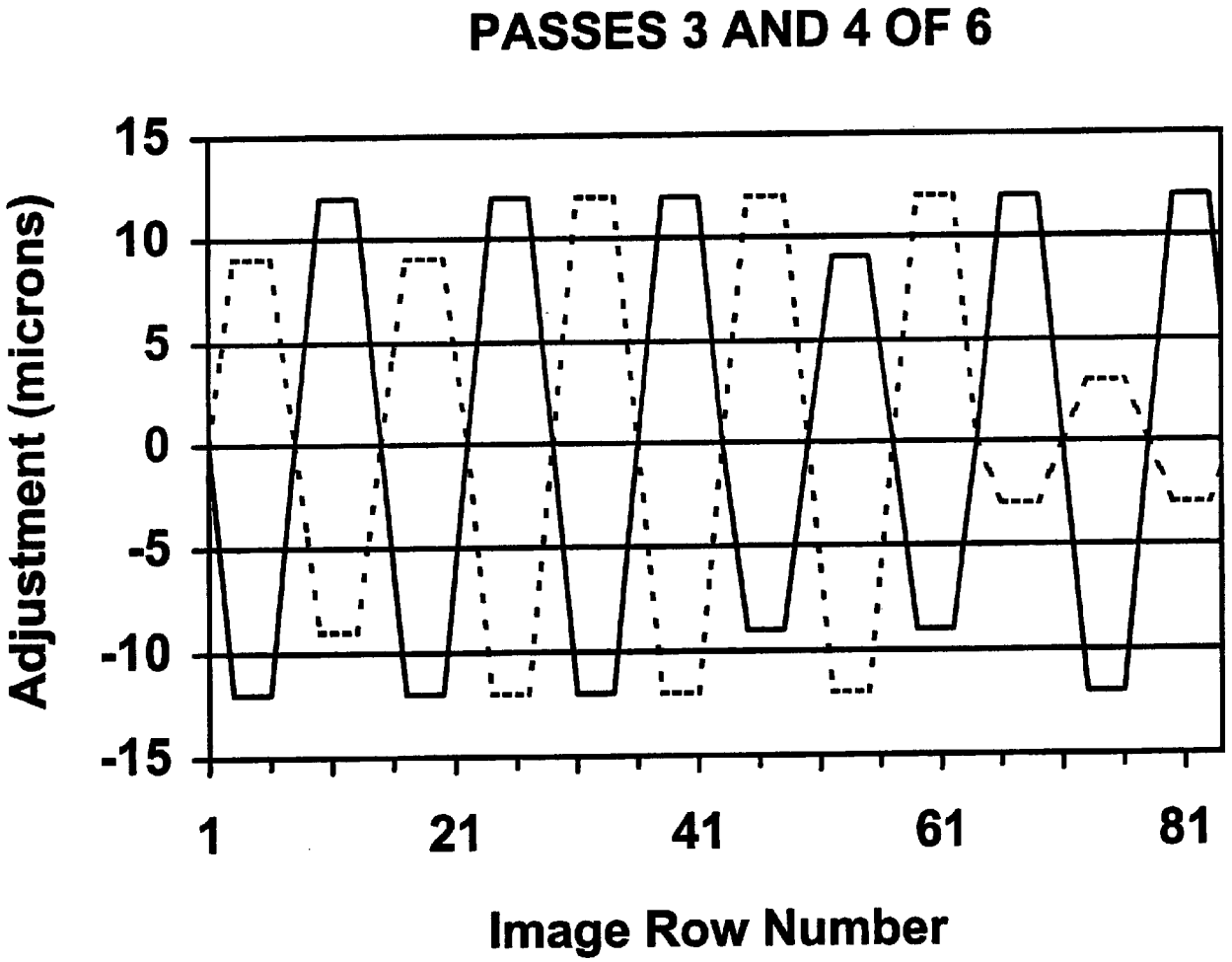
FIG. 19 is a graph showing the nozzle location adjustments in passes three and four in a six-pass printing mode employing a printhead with the exemplary nozzle location adjustments illustrated in FIG. 13.
Figure 20:
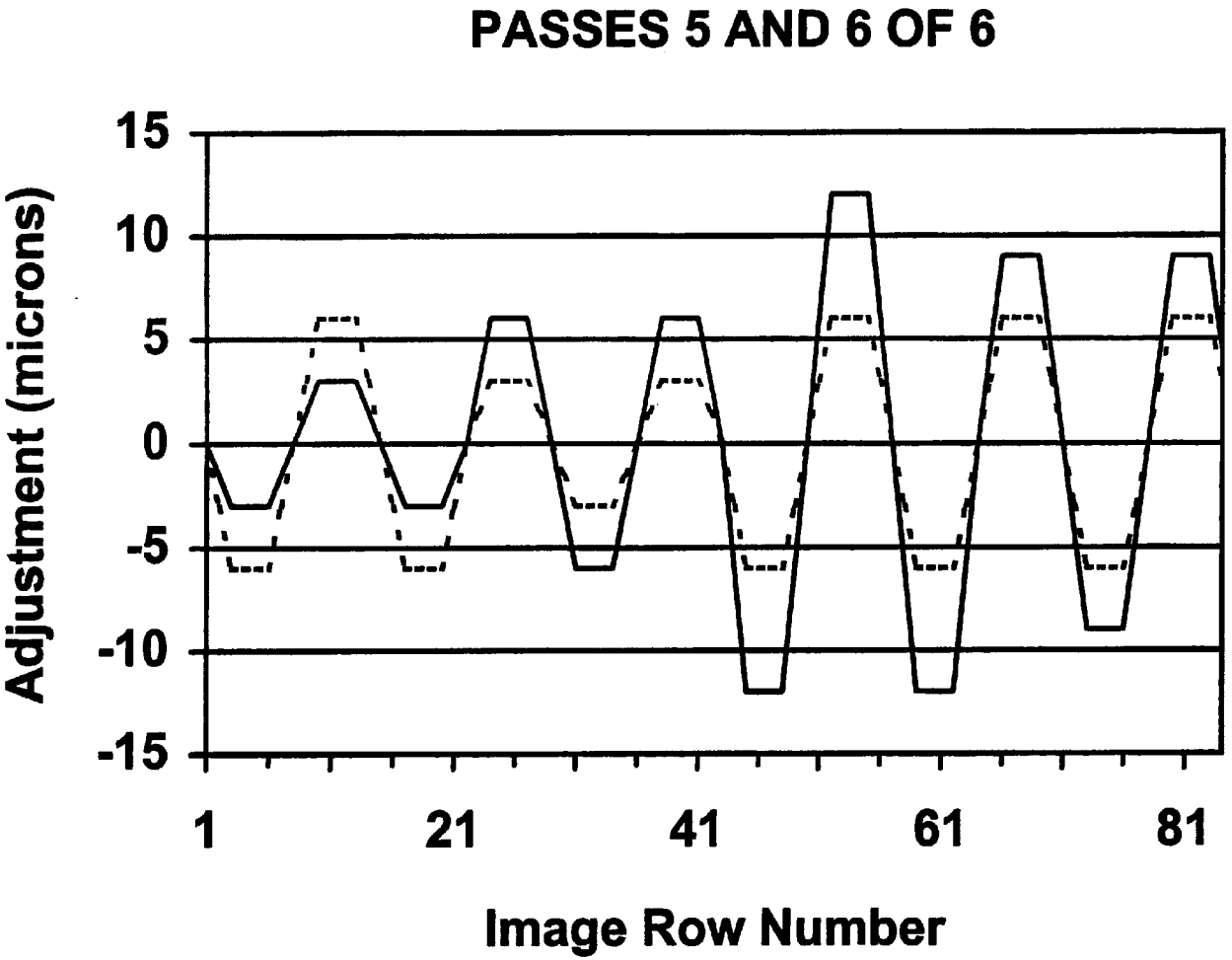
FIG. 20 is a graph showing the nozzle location adjustments in passes five and six in a six-pass printing mode employing a printhead with the exemplary nozzle location adjustments illustrated in FIG. 13.
Figure 21:
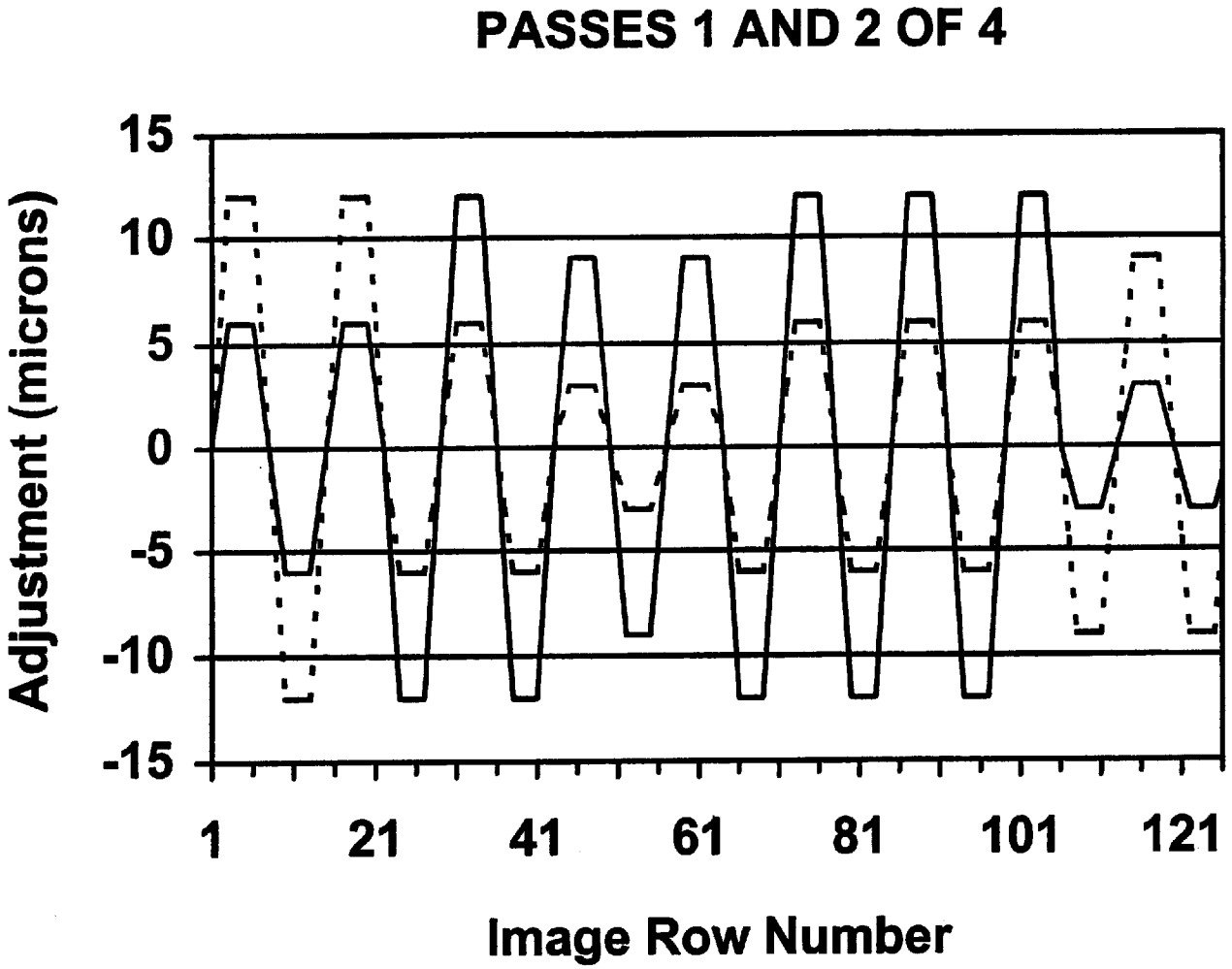
FIG. 21 is a graph showing the nozzle location adjustments in passes one and two in a four-pass printing mode employing a printhead with the exemplary nozzle location adjustments illustrated in FIG. 13.
Figure 22:
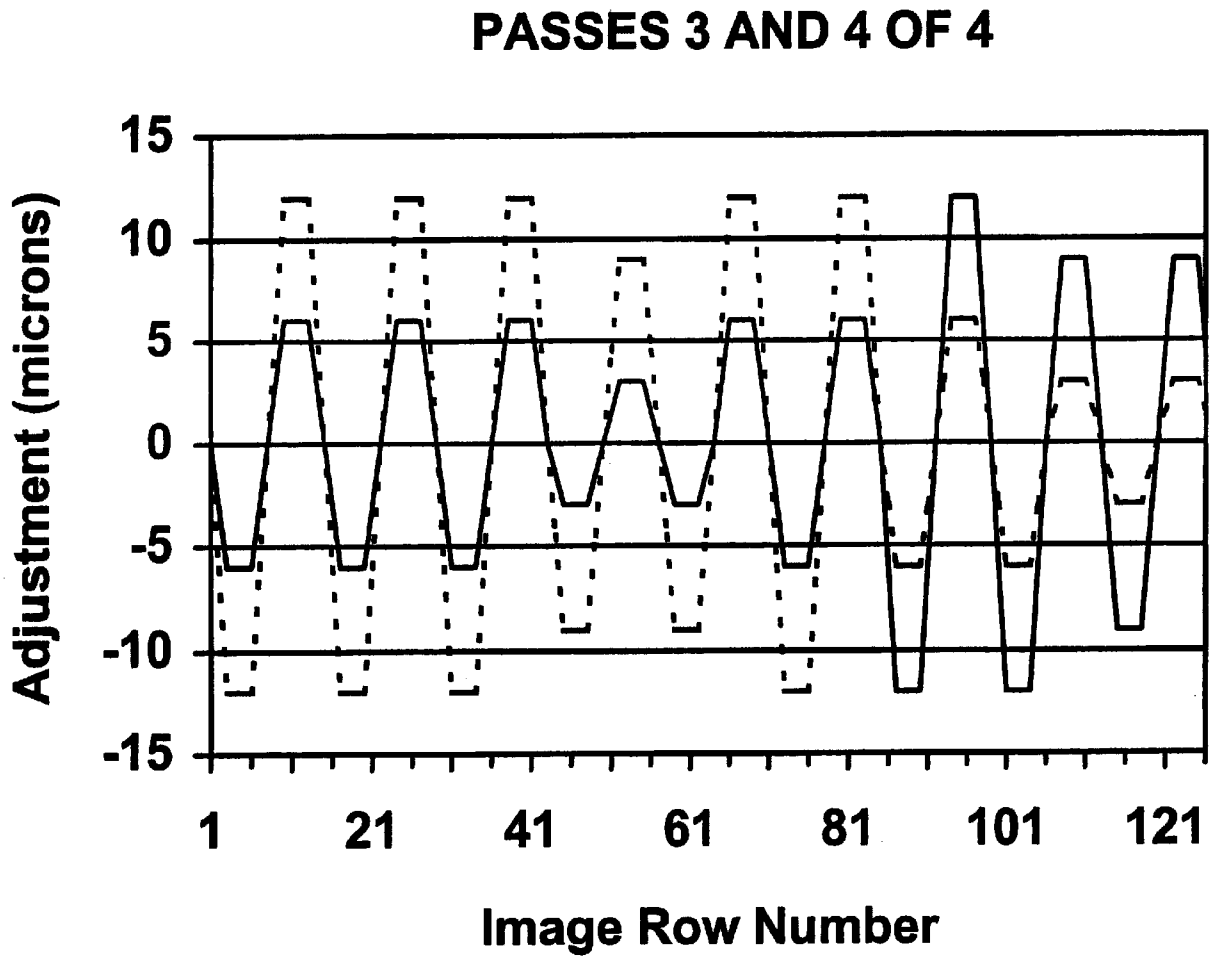
FIG. 22 is a graph showing the nozzle location adjustments in passes three and four in a four-pass printing mode employing a printhead with the exemplary nozzle location adjustments illustrated in FIG. 13.

As in the previously described embodiment, nozzles 11–514 are employed in all three of the print modes. With respect to the eight-pass mode, the adjustment amounts ΔL as a function of image row number for passes one (dash line) and two (solid line) are shown in FIG. 14, passes three (dash line) and four (solid line) are shown in FIG. 15, passes five (dash line) and six (solid line) are shown in FIG. 16, and passes seven (dash line) and eight (solid line) are shown in FIG. 17. Turning to the six-pass mode, the adjustment amounts ΔL as a function of image row number for passes one (dash line) and two (solid line) are shown in FIG. 18, passes three (dash line) and four (solid line) are shown in FIG. 19, and passes five (dash line) and six (solid line) are shown in FIG. 20. Finally, the adjustment amounts ΔL as a function of image row number for passes one (dash line) and two (solid line) in the four-pass mode are shown in FIG. 21, and passes three (dash line) and four (solid line) are shown in FIG. 22.

In accordance with another invention herein, minor directionality errors may be introduced along the carriage scan axis by selectively varying the carriage scan velocity or the firing times of the nozzles with, for example, the controller 172, to reduce or eliminate visible banding. As a result, the printer will print respective ink dots (i.e. eject ink) at dot printing locations on the carriage scan axis that are varied from the respective dot printing locations that correspond to the image information received from a host device which, in turn, varies where the dots will actually land on the print medium. Such variations in scan velocity or firing times may be employed in a printer that includes a conventional printhead, or in a printer including a printhead configured as described above with reference to FIGS. 5–22. This technique is especially useful when visible banding is due to error in ink drop velocity, carriage scan velocity, and printer cartridge/paper spacing. In addition, because it can be implemented through use of the controller 172, as opposed to requiring modification of the print cartridge and/or other mechanical devices, the present technique can be selectively turned on and off by the user as needed or desired.

Although not required, the error distribution is preferably Gaussian, as opposed to uniform. In other words, most of the dot rows are at about the location that corresponds to the image information received from a host device, while some are close to the location that corresponds to the image information received from a host device, and a few are farther away. Also, in a four-pass print mode, the magnitude of the variation will be less than that in a six-pass print mode which, in turn, will be less than that in an eight-pass print mode.

Turing first to variations in carriage velocity, a carriage in a 600 dpi printer will typically travel at 20 inches/second (ips). The controller 172 can, for example, be used to vary the carriage scan velocity such that the nozzles print dots at locations on the carriage scan axis that are offset by plus or minus one-forth of a dot row from the locations on the carriage scan axis that actually correspond to the image information received from a host device. Such variations in dot printing location correspond to variations in carriage velocity of between about plus and minus 4 ips assuming an ink drop flight time of 0.1 msec. [Note that 4 ips×600 dpi×0.1 msec=0.24 dot.] Variations in carriage velocity preferably change from pass to pass and, in some passes, there will be no variation at all. As a result, systematic visible banding will be substantially reduced or eliminated. The variations can be random, or there can be some pattern to them.

In one preferred embodiment, the scan speed may range from 18 to 22 ips. Thus, in an eight-pass mode, for example, the carriage velocity may be 18 ips, 19 ips, 19.5 ips, 20 ips, 20 ips, 20.5 ips, 21 ips, and 22 ips on successive passed. A six-pass mode could, for example, have carriage velocities of 18 ips, 19 ips, 20 ips, 20 ips, 21 ips, and 22 ips, while a four-pass mode could have carriage velocities of 19 ips, 19.5 ips, 20.5 ips, and 21 ips.

The controller 172 can also be used to vary the firing times of the nozzles. Nozzles in 600 dpi printer with a carriage velocity of 20 ips will fire (i.e. eject ink) once every 83 microseconds. Thus, to vary the firing times by an amount that corresponds to a range of plus or minus one-fourth of a dot row, for example, the firing times must be accelerated or delayed by amounts within a range of 0–20 microseconds.

Such timing variations may be implemented as follows. As noted above, the encoder strip 166 is normally indexed at time 0. The timing of the firing of the nozzles can be accelerated or delayed by varying the index time by amounts ranging from minus 20 microseconds to plus 20 microseconds. Variations in index times preferably vary from pass to pass and, in some passes, there will be no variation at all. As a result, systematic visible banding will be substantially reduced or eliminated. The variations can be random, or there can be some pattern to them.

For example, in an eight-pass mode, the encoder strip 166 can, for example, be indexed at −20 microseconds, −10 microseconds, −5 microseconds, 0 microseconds, 0 microseconds, +5 microseconds, +10 microseconds, and +20 microseconds. In a six-pass mode, the indexing may, for example, be at −15 microseconds, −10 microseconds, −5 microseconds, +5 microseconds, +10 microseconds, and +15 microseconds, while in a four-pass mode the encoder strip 166 may be indexed at −12 microseconds, −6 microseconds, +6 microseconds, and +12 microseconds.

Although the present inventions have been described in terms of the preferred embodiment above, numerous modifications and/or additions to the above-described preferred embodiment would be readily apparent to one skilled in the art. By way of example, but not limitation, variations in firing times could be accomplished by applying a random generator to each firing pulse. It is intended that the scope of the present inventions extend to all such modifications and/or additions.

I claim:

1. A printer for forming an image on print media, comprising:

a print media driver adapted to advance the print media along a print media scan axis in a print media advance direction; and a printer carriage adapted to reciprocatingly scan along a carriage scan axis; and a printhead including an integrally formed nozzle plate and a plurality of nozzles in the integrally formed nozzle plate in an array extending along the print media scan axis, the nozzles being arranged such that spacing, measured along the print media scan axis, between the nozzles in at least a first pair of adjacent nozzles is different than the spacing between the nozzles in at least a second pair of adjacent nozzles and spacing between the nozzles in at least a third pair of adjacent nozzles is different than the spacing between the nozzles in the first and second pairs of adjacent nozzles, the third pair of adjacent nozzles including one nozzle from the first pair of adjacent nozzles and one nozzle from the second pair of adjacent nozzles.

2. A printer as claimed in claim 1, wherein the nozzles comprise ink jet nozzles.

3. A printer as claimed in claim 1, wherein the spacing between adjacent nozzles progressively increases from nozzle to nozzle over a predetermined number of nozzles and then progressively decreases from nozzle to nozzle over a predetermined number of nozzles.

4. A printer as claimed in claim 1, wherein the array of nozzles comprises two side-by-side columns of nozzles.

5. A printer as claimed in claim 1, wherein the nozzles collectively define an average nozzle spacing between adjacent nozzles which corresponds to nominal nozzle locations for each nozzle and wherein some of the nozzles are located at actual nozzle locations that are offset from their respective nominal nozzle locations.

6. A printhead for use with a printer, the printer defining a print media scan axis, the printhead comprising:

an integrally formed nozzle plate; and a plurality of nozzles supported in the integrally formed nozzle plate in an array extending along the print media scan axis, the nozzles being arranged such that spacing, measured along the print media scan axis, between at least a first pair of adjacent nozzles is different than the spacing between at least a second pair of adjacent nozzles and spacing between the nozzles in at least a third pair of adjacent nozzles is different than the spacing between the nozzles in the first and second pairs of adjacent nozzles, the third pair of adjacent nozzles including one nozzle from the first pair of adjacent nozzles and one nozzle from the second pair of adjacent nozzles.

7. A printhead as claimed in claim 6, wherein the nozzles comprise ink jet nozzles.

8. A printhead as claimed in claim 6, wherein the spacing between adjacent nozzles progressively increases from nozzle to nozzle over a predetermined number of nozzles and then progressively decreases from nozzle to nozzle over a predetermined number of nozzles.

9. A printhead as claimed in claim 6, wherein the array of nozzles comprises two side-by-side columns of nozzles.

10. A printhead as claimed in claim 6, wherein the nozzles collectively define an average nozzle spacing between adjacent nozzles which corresponds to nominal nozzle locations for each nozzle and wherein some of the nozzles are located at actual nozzle locations that are offset from their respective nominal nozzle locations.

11. A printer for forming an image on print media, comprising:

a print media driver adapted to advance the print media along a print media scan axis in a print media advance direction;

a printer carriage adapted to reciprocatingly scan along a carriage scan axis;

a printhead carried by the carriage including a plurality of nozzles in an array extending along the media scan axis; and a controller operably connected to the printer carriage and printhead, the controller being adapted to receive image information from a host device corresponding to respective predetermined dot printing locations along the carriage scan axis and adapted to control at least one of the printer carriage and printhead such that at least some dots are intentionally printed at respective adjusted dot printing locations on the carriage scan axis that are offset from the respective predetermined dot locations;

wherein the carriage scans at a predetermined velocity corresponding to the predetermined dot printing locations on the carriage scan axis and the controller is adapted to vary the carriage scan velocity from the predetermined velocity by increasing the carriage scan velocity from the predetermined velocity during a first scan, decreasing the carriage scan velocity from the predetermined velocity during a second scan, and maintaining the carriage scan velocity at the predetermined velocity during a third scan.

12. A printer for forming an image on print media, comprising:

a print media driver adapted to advance the print media along a print media scan axis in a print media advance direction;

a printer carriage adapted to reciprocatingly scan along a carriage scan axis;

a printhead carried by the carriage including a plurality of nozzles in an array extending along the media scan axis; and a controller operably connected to the printer carriage and printhead, the controller being adapted to receive image information from a host device corresponding to respective predetermined dot printing locations along the carriage scan axis and adapted to control at least one of the printer carriage and printhead such that at least some dots are intentionally printed at respective adjusted dot printing locations on the carriage scan axis that are offset from the respective predetermined dot locations;

wherein the nozzles define respective predetermined firing times corresponding to the respective predetermined dot printing locations on the carriage scan axis and the controller is adapted to vary the firing times from the predetermined firing times by accelerating the respective firing times from the predetermined firing times during a first scan, delaying the firing times from the predetermined firing times during a second scan, and maintaining the firing times at the predetermined firing times during a third scan.

13. A printhead for use with a printer, the printer defining a print media scan axis, the printhead comprising:

a main body portion; and at least twenty-one spaced nozzles supported on the main body in an array extending along the print media scan axis, the at least twenty-one nozzles being arranged such that the nozzles collectively define an average nozzle spacing between adjacent nozzles which corresponds to nominal nozzle locations for each nozzle and some of the at least twenty-one nozzles are located at actual nozzle locations that are offset from their respective nominal nozzle locations in varying amounts in a first direction, some of the at least twenty-one nozzles are located at the nominal nozzle locations and some of the at least twenty-one nozzles are offset from their respective nominal nozzle locations in varying amounts in a second direction opposite the first direction and such that less than four contiguous nozzles within the at least twenty-one nozzles are located at the nominal nozzle locations.

14. A printhead as claimed in claim 13, wherein the nozzles comprise ink jet nozzles.

15. A printhead as claimed in claim 13, wherein the at least twenty-one nozzles comprises a number of nozzles equal to a whole number multiple of twenty-one.

16. A printhead as claimed in claim 15, wherein the offset amounts together define a repeating, essentially sinusoidal pattern.

17. A printhead as claimed in claim 13, wherein the nozzles located at actual nozzle locations that are offset from their respective nominal nozzle locations in a first direction are separated from the nozzles that are offset from their respective nominal nozzle locations in a second direction by at least one nozzle located at its respective nominal nozzle location.

18. A printhead as claimed in claim 13, wherein the magnitude of the varying amounts in the first direction are substantially equal to the magnitude of the varying amounts in the second direction.

19. A printhead for use with a printer, the printer defining a print media scan axis, the printhead comprising:

a main body portion; and at least twenty-one spaced nozzles supported on the main body in an array extending along the print media scan axis, the nozzles being arranged such that spacing, measured along the print media scan axis, between adjacent nozzles increases over a predetermined number of the at least twenty-one nozzles, then decreases over a predetermined number of at least twenty-one nozzles, then increases over a predetermined number of the at least twenty-one nozzles and such that the spacing between adjacent nozzles is not equal over more than four contiguous nozzles within the at least twenty-one nozzles.

20. A printhead as claimed in claim 19, wherein the nozzles comprise ink jet nozzles.

21. A printhead as claimed in claim 19, wherein the at least twenty-one nozzles comprises a number of nozzles equal to a whole number multiple of twenty-one.

* * * * *